US010499778B2

(12) United States Patent
Klintemyr et al.

(10) Patent No.: US 10,499,778 B2
(45) Date of Patent: Dec. 10, 2019

(54) ROBOTIC VACUUM CLEANER

(71) Applicant: Aktiebolaget Electrolux, Stockholm (SE)

(72) Inventors: Andreas Klintemyr, Stockholm (SE); Daniel Kastensson, Stockholm (SE)

(73) Assignee: Aktiebolaget Electrolux (SE)

( * ) Notice: Subject to any disclaimer, the term of this patent is extended or adjusted under 35 U.S.C. 154(b) by 34 days.

(21) Appl. No.: 15/504,066

(22) PCT Filed: Sep. 8, 2014

(86) PCT No.: PCT/EP2014/069073

§ 371 (c)(1),
(2) Date: Feb. 15, 2017

(87) PCT Pub. No.: WO2016/037635

PCT Pub. Date: Mar. 17, 2016

(65) Prior Publication Data

US 2017/0273524 A1 Sep. 28, 2017

(51) Int. Cl.
*A47L 9/04* (2006.01)
*A47L 5/22* (2006.01)

(52) U.S. Cl.
CPC ..... *A47L 9/0477* (2013.01); *A47L 5/22* (2013.01); *A47L 9/0411* (2013.01); *A47L 9/0488* (2013.01); *A47L 2201/00* (2013.01)

(58) Field of Classification Search
CPC ..... A47L 2201/00; A47L 5/22; A47L 9/0411; A47L 9/0477; A47L 9/0488
See application file for complete search history.

(56) References Cited

U.S. PATENT DOCUMENTS 1,286,321 A 12/1918 Hoover
1,401,007 A 12/1921 Staples
1,823,128 A 9/1931 Scott
(Continued)

FOREIGN PATENT DOCUMENTS

CA 2154758 6/1995
CN 1116818 2/1996
(Continued)

OTHER PUBLICATIONS

DE 4439427 A1—May 1996—English Machine Translation.*
(Continued)

*Primary Examiner* — Marc Carlson
(74) *Attorney, Agent, or Firm* — RatnerPrestia

(57) ABSTRACT

A robotic vacuum cleaner having a nozzle inlet arranged in a portion of a housing of the vacuum cleaner. The nozzle inlet has a frame structure forming an opening. The frame structure has a base portion extending substantially in parallel with a surface to be cleaned, the base portion extending at a first level. A leading edge portion has at least two distance members forming there between a channel to the opening. The channel has a delimiting surface extending at a second level substantially in parallel with the first level. The first level is arranged closer to the surface to be cleaned than the second level. Each distance member has a substantially triangular cross section. At least a portion of side surfaces of the distance members extend substantially perpendicularly to the base portion.

9 Claims, 3 Drawing Sheets

(56) References Cited

U.S. PATENT DOCUMENTS

| | | | |
|---|---|---|---|
| 3,010,129 | A | 11/1961 | Moore |
| 3,233,274 | A | 2/1966 | Kroll |
| 3,550,714 | A | 12/1970 | Bellinger |
| 3,570,227 | A | 3/1971 | Bellinger |
| 3,713,505 | A | 1/1973 | Muller |
| 3,837,028 | A | 9/1974 | Bridge |
| 4,028,765 | A | 6/1977 | Liebscher |
| 4,036,147 | A | 7/1977 | Westling |
| 4,114,711 | A | 9/1978 | Wilkins |
| 4,119,900 | A | 10/1978 | Kremnitz |
| 4,306,174 | A | 12/1981 | Mourier |
| 4,306,329 | A | 12/1981 | Yokoi |
| 4,369,543 | A | 1/1983 | Chen |
| 4,502,173 | A | 3/1985 | Patzold |
| 4,627,511 | A | 12/1986 | Yajima |
| 4,647,209 | A | 3/1987 | Neukomm |
| 4,800,978 | A | 1/1989 | Wasa |
| 4,822,450 | A | 4/1989 | Davis |
| 4,825,091 | A | 4/1989 | Breyer |
| 4,836,905 | A | 6/1989 | Davis |
| 4,838,990 | A | 6/1989 | Jucha |
| 4,842,686 | A | 6/1989 | Davis |
| 4,849,067 | A | 7/1989 | Jucha |
| 4,854,000 | A | 8/1989 | Takimoto |
| 4,864,511 | A | 9/1989 | Moy |
| 4,872,938 | A | 10/1989 | Davis |
| 4,878,003 | A | 10/1989 | Knepper |
| 4,886,570 | A | 12/1989 | Davis |
| 4,918,607 | A | 4/1990 | Wible |
| 4,919,224 | A | 4/1990 | Shyu |
| 4,922,559 | A | 5/1990 | Wall |
| 4,959,192 | A | 9/1990 | Trundle |
| 4,962,453 | A | 10/1990 | Pong |
| 4,989,818 | A | 2/1991 | Trundle |
| 5,001,635 | A | 3/1991 | Yasutomi |
| 5,006,302 | A | 4/1991 | Trundle |
| 5,023,444 | A | 6/1991 | Ohman |
| 5,032,775 | A | 7/1991 | Mizuno |
| 5,034,673 | A | 7/1991 | Shoji |
| 5,042,861 | A | 8/1991 | Trundle |
| 5,045,118 | A | 9/1991 | Mason |
| 5,086,535 | A | 2/1992 | Grossmeyer |
| 5,095,577 | A | 3/1992 | Jonas |
| 5,107,946 | A | 4/1992 | Kamimura |
| 5,155,683 | A | 10/1992 | Rahim |
| 5,243,732 | A | 9/1993 | Koharagi |
| 5,245,177 | A | 9/1993 | Schiller |
| 5,276,933 | A | 1/1994 | Hennessey |
| 5,279,672 | A | 1/1994 | Betker |
| 5,293,955 | A | 3/1994 | Lee |
| 5,307,273 | A | 4/1994 | Oh |
| 5,309,592 | A | 5/1994 | Hiratsuka |
| 5,341,540 | A | 8/1994 | Soupert |
| 5,345,639 | A | 9/1994 | Tanoue |
| 5,349,378 | A | 9/1994 | Maali |
| 5,353,224 | A | 10/1994 | Lee |
| 5,367,458 | A | 11/1994 | Roberts et al. |
| 5,369,347 | A | 11/1994 | Yoo |
| 5,377,106 | A | 12/1994 | Drunk |
| 5,390,627 | A | 2/1995 | van der Berg |
| 5,398,632 | A | 3/1995 | Goldbach |
| 5,402,051 | A | 3/1995 | Fujiwara |
| 5,440,216 | A | 8/1995 | Kim |
| 5,444,965 | A | 8/1995 | Colens |
| 5,446,356 | A | 8/1995 | Kim |
| 5,454,129 | A | 10/1995 | Kell |
| 5,518,552 | A | 5/1996 | Tanoue |
| 5,534,762 | A | 7/1996 | Kim |
| 5,548,511 | A | 8/1996 | Bancroft |
| 5,560,077 | A | 10/1996 | Crotchett |
| 5,568,589 | A | 10/1996 | Hwang |
| 5,621,291 | A | 4/1997 | Lee |
| 5,646,494 | A | 7/1997 | Han |
| 5,666,689 | A | 9/1997 | Andersen |
| 5,682,313 | A | 10/1997 | Edlund |
| 5,682,640 | A | 11/1997 | Han |
| 5,687,294 | A | 11/1997 | Jeong |
| 5,698,957 | A | 12/1997 | Sowada |
| 5,745,946 | A | 5/1998 | Thrasher |
| 5,758,298 | A | 5/1998 | Guldner |
| 5,778,554 | A | 7/1998 | Jones |
| 5,781,960 | A | 7/1998 | Kilstrom |
| 5,787,545 | A | 8/1998 | Colens |
| 5,815,880 | A | 10/1998 | Nakanishi |
| 5,825,981 | A | 10/1998 | Matsuda |
| 5,841,259 | A | 11/1998 | Kim |
| 5,852,984 | A | 12/1998 | Matsuyama |
| 5,867,800 | A | 2/1999 | Leif |
| 5,890,250 | A | 4/1999 | Lange |
| 5,896,488 | A | 4/1999 | Jeong |
| 5,903,124 | A | 5/1999 | Kawakami |
| 5,926,909 | A | 7/1999 | McGee |
| 5,933,902 | A | 8/1999 | Frey |
| 5,935,179 | A | 8/1999 | Kleiner |
| 5,940,927 | A | 8/1999 | Haegermarck |
| 5,942,869 | A | 8/1999 | Katou |
| 5,947,051 | A | 9/1999 | Geiger |
| 5,959,423 | A | 9/1999 | Nakanishi |
| 5,959,424 | A | 9/1999 | Elkmann |
| 5,966,765 | A | 10/1999 | Hamada |
| RE36,391 | E | 11/1999 | vandenBerg |
| 5,983,833 | A | 11/1999 | van der Lely |
| 5,987,696 | A | 11/1999 | Wang |
| 5,991,951 | A | 11/1999 | Kubo |
| 5,995,884 | A | 11/1999 | Allen |
| 5,997,670 | A | 12/1999 | Walter |
| 5,999,865 | A | 12/1999 | Bloomquist et al. |
| 6,012,470 | A | 1/2000 | Jones |
| 6,024,107 | A | 2/2000 | Jones |
| 6,064,926 | A | 5/2000 | Sarangapani |
| 6,076,662 | A | 6/2000 | Bahten |
| 6,082,377 | A | 7/2000 | Frey |
| 6,124,694 | A | 9/2000 | Bancroft |
| 6,142,252 | A | 11/2000 | Kinto |
| 6,176,067 | B1 | 1/2001 | Bahten |
| 6,213,136 | B1 | 4/2001 | Jones |
| 6,226,830 | B1 | 5/2001 | Hendriks |
| 6,230,360 | B1 | 5/2001 | Singleton |
| 6,251,551 | B1 | 6/2001 | Kunze-Concewitz |
| 6,255,793 | B1 | 7/2001 | Peless |
| 6,263,989 | B1 | 7/2001 | Won |
| 6,300,737 | B1 | 10/2001 | Bergvall |
| 6,311,366 | B1 | 11/2001 | Sepke |
| 6,327,741 | B1 | 12/2001 | Reed |
| 6,339,735 | B1 | 1/2002 | Peless |
| 6,358,325 | B1 | 3/2002 | Andreas |
| 6,360,801 | B1 | 3/2002 | Walter |
| 6,370,452 | B1 | 4/2002 | Pfister |
| 6,370,453 | B2 | 4/2002 | Sommer |
| 6,381,801 | B1 | 5/2002 | Clemons, Sr. |
| 6,389,329 | B1 | 5/2002 | Colens |
| 6,413,149 | B1 | 7/2002 | Wada |
| 6,417,641 | B2 | 7/2002 | Peless |
| 6,431,296 | B1 | 8/2002 | Won |
| 6,438,456 | B1 | 8/2002 | Feddema |
| 6,443,509 | B1 | 9/2002 | Levin |
| 6,457,199 | B1 | 10/2002 | Frost |
| 6,457,206 | B1 | 10/2002 | Judson |
| 6,459,955 | B1 | 10/2002 | Bartsch |
| 6,465,982 | B1 | 10/2002 | Bergvall |
| 6,481,515 | B1 | 11/2002 | Kirkpatrick |
| 6,482,678 | B1 | 11/2002 | Frost |
| 6,493,612 | B1 | 12/2002 | Bisset |
| 6,493,613 | B2 | 12/2002 | Peless |
| 6,496,754 | B2 | 12/2002 | Song |
| 6,504,610 | B1 | 1/2003 | Bauer |
| 6,519,804 | B1 | 2/2003 | Vujik |
| 6,525,509 | B1 | 2/2003 | Petersson |
| D471,243 | S | 3/2003 | Cioffi |
| 6,532,404 | B2 | 3/2003 | Colens |
| 6,535,793 | B2 | 3/2003 | Allard |
| 6,571,415 | B2 | 6/2003 | Gerber |
| 6,580,246 | B2 | 6/2003 | Jacobs |
| 6,581,239 | B1 | 6/2003 | Dyson |

(56) References Cited

U.S. PATENT DOCUMENTS

| | | | |
|---|---|---|---|
| 6,594,844 | B2 | 7/2003 | Jones |
| 6,597,143 | B2 | 7/2003 | Song |
| 6,601,265 | B1 | 8/2003 | Burlington |
| 6,605,156 | B1 | 8/2003 | Clark |
| 6,609,962 | B1 | 8/2003 | Wakabayashi |
| 6,611,120 | B2 | 8/2003 | Song |
| 6,611,318 | B2 | 8/2003 | LaPolice |
| 6,615,108 | B1 | 9/2003 | Peless |
| 6,615,885 | B1 | 9/2003 | Ohm |
| 6,633,150 | B1 | 10/2003 | Wallach |
| 6,637,446 | B2 | 10/2003 | Frost |
| 6,658,325 | B2 | 12/2003 | Zweig |
| 6,661,239 | B1 | 12/2003 | Ozick |
| 6,662,889 | B2 | 12/2003 | De Fazio |
| 6,667,592 | B2 | 12/2003 | Jacobs |
| 6,668,951 | B2 | 12/2003 | Won |
| 6,671,592 | B1 | 12/2003 | Bisset |
| 6,690,134 | B1 | 2/2004 | Jones |
| 6,726,823 | B1 | 4/2004 | Wang |
| 6,732,826 | B2 | 5/2004 | Song |
| 6,745,431 | B2 | 6/2004 | Dijksman |
| 6,748,297 | B2 | 6/2004 | Song |
| 6,769,004 | B2 | 7/2004 | Barrett |
| 6,774,596 | B1 | 8/2004 | Bisset |
| 6,775,871 | B1 | 8/2004 | Finch |
| 6,781,338 | B2 | 8/2004 | Jones |
| 6,809,490 | B2 | 10/2004 | Jones |
| 6,810,305 | B2 | 10/2004 | Kirkpatrick, Jr. |
| 6,820,801 | B2 | 11/2004 | Kaneko |
| 6,841,963 | B2 | 1/2005 | Song |
| 6,845,297 | B2 | 1/2005 | Allard |
| 6,850,024 | B2 | 2/2005 | Peless |
| 6,859,010 | B2 | 2/2005 | Jeon |
| 6,859,976 | B2 | 3/2005 | Plankenhorn |
| 6,860,206 | B1 | 3/2005 | Rudakevych |
| 6,868,307 | B2 | 3/2005 | Song |
| 6,869,633 | B2 | 3/2005 | Sus |
| 6,870,792 | B2 | 3/2005 | Chiappetta |
| 6,882,334 | B1 | 4/2005 | Meyer |
| 6,883,201 | B2 | 4/2005 | Jones |
| 6,885,912 | B2 | 4/2005 | Peless |
| 6,901,624 | B2 | 6/2005 | Mori |
| 6,925,679 | B2 | 8/2005 | Wallach |
| D510,066 | S | 9/2005 | Hickey |
| 6,938,298 | B2 | 9/2005 | Aasen |
| 6,939,208 | B2 | 9/2005 | Kamimura |
| 6,940,291 | B1 | 9/2005 | Ozick |
| 6,941,199 | B1 | 9/2005 | Bottomley |
| 6,942,548 | B2 | 9/2005 | Wada |
| 6,956,348 | B2 | 10/2005 | Landry |
| 6,957,712 | B2 | 10/2005 | Song |
| 6,964,312 | B2 | 11/2005 | Maggio |
| 6,965,209 | B2 | 11/2005 | Jones |
| 6,967,275 | B2 | 11/2005 | Ozick |
| 6,971,140 | B2 | 12/2005 | Kim |
| 6,971,141 | B1 | 12/2005 | Tak |
| 6,984,952 | B2 | 1/2006 | Peless |
| 7,000,623 | B2 | 2/2006 | Welsh |
| 7,004,269 | B2 | 2/2006 | Song |
| 7,013,200 | B2 | 3/2006 | Wakui |
| 7,013,527 | B2 | 3/2006 | Thomas, Sr. |
| 7,015,831 | B2 | 3/2006 | Karlsson |
| 7,024,278 | B2 | 4/2006 | Chiappetta |
| 7,031,805 | B2 | 4/2006 | Lee |
| 7,040,968 | B2 | 5/2006 | Kamimura |
| 7,042,342 | B2 | 5/2006 | Luo |
| 7,043,794 | B2 | 5/2006 | Conner |
| 7,050,926 | B2 | 5/2006 | Theurer et al. |
| 7,053,578 | B2 | 5/2006 | Diehl et al. |
| 7,053,580 | B2 | 5/2006 | Aldred |
| 7,054,716 | B2 | 5/2006 | McKee |
| 7,059,012 | B2 | 6/2006 | Song |
| 7,079,923 | B2 | 7/2006 | Abramson |
| 7,082,350 | B2 | 7/2006 | Skoog |
| D526,753 | S | 8/2006 | Tani |
| 7,085,624 | B2 | 8/2006 | Aldred |
| 7,103,449 | B2 | 9/2006 | Woo |
| 7,113,847 | B2 | 9/2006 | Chmura |
| 7,117,067 | B2 | 10/2006 | McLurkin |
| 7,133,745 | B2 | 11/2006 | Wang |
| 7,134,164 | B2 | 11/2006 | Alton |
| 7,135,992 | B2 | 11/2006 | Karlsson |
| 7,143,696 | B2 | 12/2006 | Rudakevych |
| 7,145,478 | B2 | 12/2006 | Goncalves |
| 7,150,068 | B1 | 12/2006 | Ragner |
| 7,155,308 | B2 | 12/2006 | Jones |
| 7,155,309 | B2 | 12/2006 | Peless |
| 7,162,338 | B2 | 1/2007 | Goncalves |
| 7,167,775 | B2 | 1/2007 | Abramson |
| 7,173,391 | B2 | 2/2007 | Jones |
| 7,174,238 | B1 | 2/2007 | Zweig |
| 7,177,737 | B2 | 2/2007 | Karlsson |
| 7,184,586 | B2 | 2/2007 | Jeon |
| 7,185,396 | B2 | 3/2007 | Im |
| 7,185,397 | B2 | 3/2007 | Stuchlik |
| 7,188,000 | B2 | 3/2007 | Chiappetta |
| 7,196,487 | B2 | 3/2007 | Jones |
| 7,199,711 | B2 | 4/2007 | Field |
| 7,200,892 | B2 | 4/2007 | Kim |
| 7,202,630 | B2 | 4/2007 | Dan |
| 7,206,677 | B2 | 4/2007 | Hulden |
| 7,207,081 | B2 | 4/2007 | Gerber |
| 7,208,892 | B2 | 4/2007 | Tondra |
| 7,213,298 | B2 | 5/2007 | Cipolla |
| 7,213,663 | B2 | 5/2007 | Kim |
| 7,222,390 | B2 | 5/2007 | Cipolla |
| 7,225,500 | B2 | 6/2007 | Diehl |
| 7,237,298 | B2 | 7/2007 | Reindle |
| 7,240,396 | B2 | 7/2007 | Thomas, Sr. |
| 7,246,405 | B2 | 7/2007 | Yan |
| 7,248,951 | B2 | 7/2007 | Hulden |
| 7,251,853 | B2 | 8/2007 | Park |
| 7,254,464 | B1 | 8/2007 | McLurkin |
| 7,254,859 | B2 | 8/2007 | Gerber |
| 7,269,877 | B2 | 9/2007 | Tondra |
| 7,272,467 | B2 | 9/2007 | Goncalves |
| 7,272,868 | B2 | 9/2007 | Im |
| 7,274,167 | B2 | 9/2007 | Kim |
| 7,275,280 | B2 | 10/2007 | Haegermarck |
| 7,288,912 | B2 | 10/2007 | Landry |
| D556,961 | S | 12/2007 | Swyst |
| 7,303,776 | B2 | 12/2007 | Sus |
| 7,324,870 | B2 | 1/2008 | Lee |
| 7,331,436 | B1 | 2/2008 | Pack |
| 7,332,890 | B2 | 2/2008 | Cohen |
| 7,343,221 | B2 | 3/2008 | Ann |
| 7,343,719 | B2 | 3/2008 | Sus |
| 7,346,428 | B1 | 3/2008 | Huffman |
| 7,349,759 | B2 | 3/2008 | Peless |
| 7,359,766 | B2 | 4/2008 | Jeon |
| 7,363,994 | B1 | 4/2008 | DeFazio |
| 7,369,460 | B2 | 5/2008 | Chiappetta |
| 7,372,004 | B2 | 5/2008 | Buchner |
| 7,388,343 | B2 | 6/2008 | Jones |
| 7,389,156 | B2 | 6/2008 | Ziegler |
| 7,389,166 | B2 | 6/2008 | Harwig |
| 7,403,360 | B2 | 7/2008 | Cunningham |
| 7,412,748 | B2 | 8/2008 | Lee |
| 7,417,404 | B2 | 8/2008 | Lee |
| 7,418,762 | B2 | 9/2008 | Arai |
| 7,424,766 | B2 | 9/2008 | Reindle |
| 7,429,843 | B2 | 9/2008 | Jones |
| 7,430,455 | B2 | 9/2008 | Casey |
| 7,438,766 | B2 | 10/2008 | Song |
| 7,441,298 | B2 | 10/2008 | Svendsen |
| 7,444,206 | B2 | 10/2008 | Abramson |
| 7,448,113 | B2 | 11/2008 | Jones |
| 7,459,871 | B2 | 12/2008 | Landry |
| 7,464,157 | B2 | 12/2008 | Okude |
| 7,474,941 | B2 | 1/2009 | Kim |
| 7,480,958 | B2 | 1/2009 | Song |
| 7,480,960 | B2 | 1/2009 | Kim |
| D586,959 | S | 2/2009 | Geringer |
| 7,489,277 | B2 | 2/2009 | Sung |

(56) References Cited

U.S. PATENT DOCUMENTS 7,489,985 B2 2/2009 Ko
7,499,774 B2 3/2009 Barrett
7,499,775 B2 3/2009 Filippov
7,499,776 B2 3/2009 Allard
7,499,804 B2 3/2009 Svendsen
7,503,096 B2 3/2009 Lin
7,515,991 B2 4/2009 Egawa
D593,265 S 5/2009 Carr
7,539,557 B2 5/2009 Yamauchi
7,546,891 B2 6/2009 Won
7,546,912 B1 6/2009 Pack
7,555,363 B2 6/2009 Augenbraun
7,556,108 B2 7/2009 Won
7,559,269 B2 7/2009 Rudakevych
7,564,571 B2 7/2009 Karabassi
7,566,839 B2 7/2009 Hukuba
7,567,052 B2 7/2009 Jones
7,568,259 B2 8/2009 Yan
7,568,536 B2 8/2009 Yu
7,571,511 B2 8/2009 Jones
7,573,403 B2 8/2009 Goncalves
7,574,282 B2 8/2009 Petersson
7,578,020 B2 8/2009 Jaworski
7,579,803 B2 8/2009 Jones
7,581,282 B2 9/2009 Woo
7,597,162 B2 10/2009 Won
7,600,521 B2 10/2009 Woo
7,600,593 B2 10/2009 Filippov
7,603,744 B2 10/2009 Reindle
7,604,675 B2 10/2009 Makarov
7,610,651 B2 11/2009 Baek
7,613,543 B2 11/2009 Petersson
7,620,476 B2 11/2009 Morse
7,636,982 B2 12/2009 Jones
7,647,144 B2 1/2010 Haegermarck
7,650,666 B2 1/2010 Jang
7,654,348 B2 2/2010 Ohm
7,660,650 B2 2/2010 Kawagoe
7,663,333 B2 2/2010 Jones
7,673,367 B2 3/2010 Kim
7,679,532 B2 3/2010 Karlsson
7,688,676 B2 3/2010 Chiappetta
7,693,654 B1 4/2010 Dietsch
7,697,141 B2 4/2010 Jones
7,706,917 B1 4/2010 Chiappetta
7,706,921 B2 4/2010 Jung
7,709,497 B2 5/2010 Christensen, IV
7,711,450 B2 5/2010 Im
7,720,572 B2 5/2010 Ziegler
7,721,829 B2 5/2010 Lee
7,729,801 B2 6/2010 Abramson
7,749,294 B2 7/2010 Oh
7,751,940 B2 7/2010 Lee
7,761,954 B2 7/2010 Ziegler
7,765,635 B2 8/2010 Park
7,765,638 B2 8/2010 Pineschi et al.
7,769,490 B2 8/2010 Abramson
7,774,158 B2 8/2010 Domingues Goncalves
7,779,504 B2 8/2010 Lee
7,780,796 B2 8/2010 Shim
7,784,139 B2 8/2010 Sawalski
7,784,570 B2 8/2010 Couture
7,785,544 B2 8/2010 Alward
7,787,991 B2 8/2010 Jeung
7,793,614 B2 9/2010 Ericsson
7,801,645 B2 9/2010 Taylor
7,805,220 B2 9/2010 Taylor
7,827,653 B1 11/2010 Liu
7,832,048 B2 11/2010 Harwig
7,835,529 B2 11/2010 Hernandez
7,843,431 B2 11/2010 Robbins
7,844,364 B2 11/2010 McLurkin
7,849,555 B2 12/2010 Hahm
7,856,291 B2 12/2010 Jung
7,860,608 B2 12/2010 Lee
7,861,365 B2 1/2011 Sun
7,861,366 B2 1/2011 Hahm
7,873,437 B2 1/2011 Aldred
7,877,166 B2 1/2011 Harwig
7,886,399 B2 2/2011 Dayton
7,890,210 B2 2/2011 Choi
7,891,045 B2 2/2011 Kim
7,891,289 B2 2/2011 Day
7,891,446 B2 2/2011 Couture
7,894,951 B2 2/2011 Norris
7,916,931 B2 3/2011 Lee
7,920,941 B2 4/2011 Park
7,921,506 B2 4/2011 Baek
7,926,598 B2 4/2011 Rudakevych
7,934,571 B2 5/2011 Chiu
7,937,800 B2 5/2011 Yan
7,942,107 B2 5/2011 Vosburgh
7,957,837 B2 6/2011 Ziegler
7,962,997 B2 6/2011 Chung
7,966,339 B2 6/2011 Kim
7,975,790 B2 7/2011 Kim
7,979,175 B2 7/2011 Allard
7,979,945 B2 7/2011 Dayton
7,981,455 B2 7/2011 Sus
7,997,118 B2 8/2011 Mecca
8,001,651 B2 8/2011 Chang
8,007,221 B1 8/2011 More
8,010,229 B2 8/2011 Kim
8,019,223 B2 9/2011 Hudson
8,020,657 B2 9/2011 Allard
8,032,978 B2 10/2011 Haegermarck
8,034,390 B2 10/2011 Sus
8,042,663 B1 10/2011 Pack
8,046,103 B2 10/2011 Abramson
8,061,461 B2 11/2011 Couture
8,065,778 B2 11/2011 Kim
8,073,439 B2 12/2011 Stromberg
8,074,752 B2 12/2011 Rudakevych
8,078,338 B2 12/2011 Pack
8,079,432 B2 12/2011 Ohm
8,082,836 B2 12/2011 More
8,086,419 B2 12/2011 Goncalves
8,087,117 B2 1/2012 Kapoor
8,095,238 B2 1/2012 Jones
8,095,336 B2 1/2012 Goncalves
8,107,318 B2 1/2012 Chiappetta
8,108,092 B2 1/2012 Phillips
8,109,191 B1 2/2012 Rudakevych
8,112,942 B2 2/2012 Bohm
8,113,304 B2 2/2012 Won
8,122,982 B2 2/2012 Morey
8,127,396 B2 3/2012 Mangiardi
8,127,399 B2 3/2012 Dilger
8,127,704 B2 3/2012 Vosburgh
8,136,200 B2 3/2012 Splinter
8,150,650 B2 4/2012 Goncalves
D659,311 S 5/2012 Geringer
8,166,904 B2 5/2012 Israel
8,195,333 B2 6/2012 Ziegler
8,196,251 B2 6/2012 Lynch
8,199,109 B2 6/2012 Robbins
8,200,600 B2 6/2012 Rosenstein
8,200,700 B2 6/2012 Moore
8,237,389 B2 8/2012 Fitch
8,237,920 B2 8/2012 Jones
8,239,992 B2 8/2012 Schnittman
8,244,469 B2 8/2012 Cheung
8,253,368 B2 8/2012 Landry
8,255,092 B2 8/2012 Phillips
8,256,542 B2 9/2012 Couture
8,265,793 B2 9/2012 Cross
8,274,406 B2 9/2012 Karlsson
8,281,703 B2 10/2012 Moore
8,281,731 B2 10/2012 Vosburgh
8,290,619 B2 10/2012 McLurkin
8,292,007 B2 10/2012 DeFazio
8,295,125 B2 10/2012 Chiappetta
D670,877 S 11/2012 Geringer
8,308,529 B2 11/2012 DAmbra et al.

(56) References Cited

U.S. PATENT DOCUMENTS 8,311,674 B2 11/2012 Abramson
8,316,971 B2 11/2012 Couture
8,318,499 B2 11/2012 Fritchie
D672,928 S 12/2012 Swett
8,322,470 B2 12/2012 Ohm
8,326,469 B2 12/2012 Phillips
8,327,960 B2 12/2012 Couture
8,336,479 B2 12/2012 Vosburgh
8,342,271 B2 1/2013 Filippov
8,347,088 B2 1/2013 Moore
8,347,444 B2 1/2013 Schnittman
8,350,810 B2 1/2013 Robbins
8,353,373 B2 1/2013 Rudakevych
8,364,309 B1 1/2013 Bailey
8,364,310 B2 1/2013 Jones
8,365,848 B2 2/2013 Won
8,368,339 B2 2/2013 Jones
8,370,985 B2 2/2013 Schnittman
8,374,721 B2 2/2013 Halloran
8,375,838 B2 2/2013 Rudakevych
8,378,613 B2 2/2013 Landry
8,380,350 B2 * 2/2013 Ozick ..... A47L 5/30 700/253
8,382,906 B2 2/2013 Konandreas
8,386,081 B2 2/2013 Landry
8,387,193 B2 3/2013 Ziegler
8,390,251 B2 3/2013 Cohen
8,392,021 B2 3/2013 Konandreas
8,396,592 B2 3/2013 Jones
8,396,611 B2 3/2013 Phillips
8,402,586 B2 3/2013 Lavabre
8,408,956 B1 4/2013 Vosburgh
8,412,377 B2 4/2013 Casey
8,413,752 B2 4/2013 Page
8,417,188 B1 4/2013 Vosburgh
8,417,383 B2 4/2013 Ozick
8,418,303 B2 4/2013 Kapoor
8,418,642 B2 4/2013 Vosburgh
8,428,778 B2 4/2013 Landry
8,433,442 B2 4/2013 Friedman
D682,362 S 5/2013 Mozeika
8,438,694 B2 5/2013 Kim
8,438,695 B2 5/2013 Gilbert, Jr.
8,438,698 B2 5/2013 Kim
8,447,440 B2 5/2013 Phillips
8,447,613 B2 5/2013 Hussey
8,452,448 B2 5/2013 Pack
8,453,289 B2 6/2013 Lynch
8,456,125 B2 6/2013 Landry
8,461,803 B2 6/2013 Cohen
8,463,438 B2 6/2013 Jones
8,473,140 B2 6/2013 Norris
8,474,090 B2 7/2013 Jones
8,478,442 B2 7/2013 Casey
8,485,330 B2 7/2013 Pack
8,505,158 B2 8/2013 Han
8,508,388 B2 8/2013 Karlsson
8,515,578 B2 8/2013 Chiappetta
8,516,651 B2 8/2013 Jones
8,525,995 B2 9/2013 Jones
8,527,113 B2 9/2013 Yamauchi
8,528,157 B2 9/2013 Schnittman
8,528,162 B2 9/2013 Tang
8,528,673 B2 9/2013 More
8,532,822 B2 9/2013 Abramson
8,533,144 B1 9/2013 Reeser
8,534,983 B2 9/2013 Schoenfeld
8,543,562 B2 9/2013 Mule
8,548,626 B2 10/2013 Steltz
8,551,254 B2 10/2013 Dayton
8,551,421 B2 10/2013 Luchinger
8,565,920 B2 10/2013 Casey
8,572,799 B2 11/2013 Won
8,584,305 B2 11/2013 Won
8,584,306 B2 11/2013 Chung
8,584,307 B2 11/2013 Won
8,594,840 B1 11/2013 Chiappetta
8,598,829 B2 12/2013 Landry
8,599,645 B2 12/2013 Chiappetta
8,600,553 B2 12/2013 Svendsen
8,606,401 B2 12/2013 Ozick
8,634,956 B1 1/2014 Chiappetta
8,634,958 B1 1/2014 Chiappetta
8,666,523 B2 3/2014 Kim
8,671,513 B2 3/2014 Yoo et al.
8,732,895 B2 5/2014 Cunningham
8,741,013 B2 6/2014 Swett et al.
8,743,286 B2 6/2014 Hasegawa
8,745,194 B2 6/2014 Uribe-Etxebarria Jimenez
8,755,936 B2 6/2014 Friedman
8,761,931 B2 6/2014 Halloran
8,763,200 B2 7/2014 Kim
8,774,970 B2 7/2014 Knopow
8,798,791 B2 8/2014 Li
8,798,792 B2 8/2014 Park
8,799,258 B2 8/2014 Mule
8,838,274 B2 9/2014 Jones
8,839,477 B2 9/2014 Schnittman
8,843,245 B2 9/2014 Choe
8,855,914 B1 10/2014 Alexander
8,874,264 B1 10/2014 Chiappetta
8,881,339 B2 11/2014 Gilbert, Jr.
8,924,042 B2 12/2014 Kim
8,961,695 B2 2/2015 Romanov
8,985,127 B2 3/2015 Konandreas
8,996,172 B2 3/2015 Shah et al.
9,033,079 B2 5/2015 Shin
9,037,396 B2 5/2015 Pack
9,144,361 B2 9/2015 Landry
9,360,300 B2 6/2016 DiBernado
9,687,132 B2 6/2017 Schlischka
10,045,675 B2 * 8/2018 Haegermarck ..... A47L 9/0488
2001/0004719 A1 6/2001 Sommer
2001/0037163 A1 11/2001 Allard
2002/0016649 A1 2/2002 Jones
2002/0091466 A1 7/2002 Song
2002/0108635 A1 8/2002 Marrero
2002/0121288 A1 9/2002 Marrero
2002/0121561 A1 9/2002 Marrero
2002/0164932 A1 11/2002 Kamimura
2002/0174506 A1 11/2002 Wallach
2002/0185071 A1 12/2002 Guo
2002/0189871 A1 12/2002 Won
2003/0000034 A1 1/2003 Welsh
2003/0025472 A1 2/2003 Jones
2003/0030398 A1 2/2003 Jacobs
2003/0120972 A1 6/2003 Matsushima
2003/0140449 A1 * 7/2003 Alton ..... A47L 9/02 15/375
2003/0159223 A1 8/2003 Plankenhorn
2003/0167000 A1 9/2003 Mullick
2003/0229421 A1 12/2003 Chmura
2004/0020000 A1 2/2004 Jones
2004/0031111 A1 2/2004 Porchia
2004/0031121 A1 2/2004 Martin
2004/0034952 A1 2/2004 Ho
2004/0049877 A1 3/2004 Jones
2004/0049878 A1 3/2004 Thomas
2004/0074038 A1 4/2004 Im
2004/0074039 A1 4/2004 Kim
2004/0098167 A1 5/2004 Yi
2004/0111184 A1 6/2004 Chiappetta
2004/0111827 A1 6/2004 Im
2004/0167667 A1 8/2004 Goncalves
2004/0181896 A1 9/2004 Egawa
2004/0182839 A1 9/2004 Denney
2004/0182840 A1 9/2004 Denney
2004/0185011 A1 9/2004 Alexander
2004/0187249 A1 9/2004 Jones
2004/0207355 A1 10/2004 Jones
2004/0208212 A1 10/2004 Denney
2004/0210343 A1 10/2004 Kim
2004/0220707 A1 11/2004 Pallister
2005/0010331 A1 1/2005 Taylor

(56) References Cited

U.S. PATENT DOCUMENTS

2005/0015912 A1 1/2005 Kim
2005/0015915 A1 1/2005 Thomas
2005/0028315 A1 2/2005 Thomas
2005/0028316 A1 2/2005 Thomas
2005/0042151 A1 2/2005 Alward
2005/0065662 A1 3/2005 Reindle
2005/0085947 A1 4/2005 Aldred
2005/0088643 A1 4/2005 Anderson
2005/0156562 A1 7/2005 Cohen
2005/0166354 A1 8/2005 Uehigashi
2005/0191949 A1 9/2005 Kamimura
2005/0217061 A1 10/2005 Reindle
2005/0223514 A1 10/2005 Stuchlik
2005/0229340 A1 10/2005 Sawalski
2005/0230166 A1 10/2005 Petersson
2005/0234611 A1 10/2005 Uehigashi
2005/0251292 A1 11/2005 Casey
2005/0251457 A1 11/2005 Kashiwagi
2005/0251947 A1 11/2005 Lee
2005/0267629 A1 12/2005 Petersson
2005/0278888 A1 12/2005 Reindle
2005/0287038 A1 12/2005 Dubrovsky
2006/0009879 A1 1/2006 Lynch
2006/0010799 A1 1/2006 Bohm
2006/0020369 A1 1/2006 Taylor
2006/0028306 A1 2/2006 Hukuba
2006/0032013 A1 2/2006 Kim
2006/0045981 A1 3/2006 Tsushi
2006/0076039 A1 4/2006 Song et al.
2006/0095158 A1 5/2006 Lee
2006/0136096 A1 6/2006 Chiappetta
2006/0144834 A1 7/2006 Denney
2006/0178777 A1 8/2006 Park
2006/0190133 A1 8/2006 Konandreas
2006/0190134 A1 8/2006 Ziegler
2006/0190146 A1 8/2006 Morse
2006/0195015 A1 8/2006 Mullick
2006/0200281 A1 9/2006 Ziegler
2006/0213025 A1 9/2006 Sawalski
2006/0235570 A1 10/2006 Jung
2006/0235585 A1 10/2006 Tanaka
2006/0236492 A1 10/2006 Sudo
2006/0288519 A1 12/2006 Jaworski
2006/0293788 A1 12/2006 Pogodin
2007/0016328 A1 1/2007 Ziegler
2007/0021867 A1 1/2007 Woo
2007/0059441 A1 3/2007 Greer
2007/0061040 A1 3/2007 Augenbraun et al.
2007/0114975 A1 5/2007 Cohen
2007/0118248 A1 5/2007 Lee et al.
2007/0124890 A1 6/2007 Erko
2007/0143950 A1 6/2007 Lin
2007/0156286 A1 7/2007 Yamauchi
2007/0179670 A1 8/2007 Chiappetta
2007/0189347 A1 8/2007 Denney
2007/0204426 A1 9/2007 Nakagawa
2007/0213892 A1 9/2007 Jones
2007/0214601 A1 9/2007 Chung
2007/0234492 A1 10/2007 Svendsen
2007/0244610 A1 10/2007 Ozick
2007/0266508 A1 11/2007 Jones
2007/0267230 A1 11/2007 Won
2007/0267570 A1 11/2007 Park
2007/0267998 A1 11/2007 Cohen
2007/0273864 A1 11/2007 Cho
2007/0276541 A1 11/2007 Sawasaki
2007/0285041 A1 12/2007 Jones
2007/0289267 A1 12/2007 Makarov
2007/0290649 A1 12/2007 Jones
2008/0000041 A1 1/2008 Jones
2008/0000042 A1 1/2008 Jones
2008/0001566 A1 1/2008 Jones
2008/0007203 A1 1/2008 Cohen
2008/0009964 A1 1/2008 Bruemmer et al.
2008/0015738 A1 1/2008 Casey
2008/0016631 A1 1/2008 Casey
2008/0037170 A1 2/2008 Saliba
2008/0039974 A1 2/2008 Sandin
2008/0047092 A1 2/2008 Schnittman
2008/0051953 A1 2/2008 Jones
2008/0007193 A1 3/2008 Bow
2008/0052846 A1 3/2008 Kapoor
2008/0058987 A1 3/2008 Ozick
2008/0063400 A1 3/2008 Hudson
2008/0065265 A1 3/2008 Ozick
2008/0077278 A1 3/2008 Park
2008/0084174 A1 4/2008 Jones
2008/0086241 A1 4/2008 Phillips
2008/0091304 A1 4/2008 Ozick
2008/0091305 A1 4/2008 Svendsen
2008/0093131 A1 4/2008 Couture
2008/0098553 A1 5/2008 Dayton
2008/0105445 A1 5/2008 Dayton
2008/0109126 A1 5/2008 Sandin
2008/0121097 A1 5/2008 Rudakevych
2008/0127445 A1 6/2008 Konandreas
2008/0127446 A1 6/2008 Ziegler
2008/0133052 A1 6/2008 Jones
2008/0134457 A1 6/2008 Morse
2008/0134458 A1 6/2008 Ziegler
2008/0140255 A1 6/2008 Ziegler
2008/0143063 A1 6/2008 Won
2008/0143064 A1 6/2008 Won
2008/0143065 A1 6/2008 DeFazio
2008/0152871 A1 6/2008 Greer
2008/0155768 A1 7/2008 Ziegler
2008/0179115 A1 7/2008 Ohm
2008/0183332 A1 7/2008 Ohm
2008/0184518 A1 8/2008 Taylor
2008/0196946 A1 8/2008 Filippov
2008/0205194 A1 8/2008 Chiappetta
2008/0209665 A1 9/2008 Mangiardi
2008/0221729 A1 9/2008 Lavarec
2008/0223630 A1 9/2008 Couture
2008/0235897 A1 10/2008 Kim
2008/0236907 A1 10/2008 Won
2008/0264456 A1 10/2008 Lynch
2008/0266254 A1 10/2008 Robbins
2008/0276407 A1 11/2008 Schnittman
2008/0276408 A1 11/2008 Gilbert
2008/0281470 A1 11/2008 Gilbert
2008/0282494 A1 11/2008 Won
2008/0294288 A1 11/2008 Yamauchi
2008/0307590 A1 12/2008 Jones
2009/0007366 A1 1/2009 Svendsen
2009/0025155 A1 1/2009 Nishiyama
2009/0030551 A1 1/2009 Hein et al.
2009/0037024 A1 2/2009 Jamieson
2009/0038089 A1 2/2009 Landry
2009/0044370 A1 2/2009 Won
2009/0045766 A1 2/2009 Casey
2009/0055022 A1 2/2009 Casey
2009/0065271 A1 3/2009 Won
2009/0070946 A1 3/2009 Tamada
2009/0078035 A1 3/2009 Mecca
2009/0107738 A1 4/2009 Won
2009/0125175 A1 5/2009 Park
2009/0126143 A1* 5/2009 Haegermarck ..... A47L 9/00 15/319
2009/0133720 A1 5/2009 Vandenbogert
2009/0145671 A1 6/2009 Filippov
2009/0173553 A1 7/2009 Won
2009/0180668 A1 7/2009 Jones
2009/0226113 A1 9/2009 Matsumoto et al.
2009/0232506 A1 9/2009 Hudson
2009/0241826 A1 10/2009 Vosburgh
2009/0254217 A1 10/2009 Pack
2009/0254218 A1 10/2009 Sandin
2009/0265036 A1 10/2009 Jamieson
2009/0270015 A1 10/2009 DAmbra
2009/0274602 A1 11/2009 Alward
2009/0281661 A1 11/2009 Dooley et al.
2009/0292393 A1 11/2009 Casey
2009/0292884 A1 11/2009 Wang

(56) References Cited

U.S. PATENT DOCUMENTS

2009/0314318 A1 12/2009 Chang
2009/0314554 A1 12/2009 Couture
2009/0319083 A1 12/2009 Jones
2010/0001478 A1 1/2010 DeFazio
2010/0011529 A1 1/2010 Won
2010/0037418 A1* 2/2010 Hussey ..... A47L 5/30 15/319
2010/0049364 A1 2/2010 Landry
2010/0049365 A1 2/2010 Jones
2010/0049391 A1 2/2010 Nakano
2010/0063628 A1 3/2010 Landry
2010/0075054 A1 3/2010 Kaneyama
2010/0076600 A1 3/2010 Cross
2010/0078415 A1 4/2010 Denney
2010/0082193 A1 4/2010 Chiappetta
2010/0107355 A1 5/2010 Won
2010/0108098 A1 5/2010 Splinter
2010/0115716 A1 5/2010 Landry
2010/0116566 A1 5/2010 Ohm
2010/0125968 A1 5/2010 Ho
2010/0139029 A1 6/2010 Kim
2010/0139995 A1 6/2010 Rudakevych
2010/0161225 A1 6/2010 Hyung et al.
2010/0173070 A1 7/2010 Niu
2010/0206336 A1 8/2010 Souid
2010/0217436 A1 8/2010 Jones
2010/0257690 A1 10/2010 Jones
2010/0257691 A1 10/2010 Jones
2010/0263142 A1 10/2010 Jones
2010/0263158 A1 10/2010 Jones
2010/0268384 A1 10/2010 Jones
2010/0275405 A1 11/2010 Morse
2010/0286791 A1 11/2010 Goldsmith
2010/0305752 A1 12/2010 Abramson
2010/0312429 A1 12/2010 Jones
2010/0313910 A1 12/2010 Lee
2010/0313912 A1 12/2010 Han
2011/0000363 A1 1/2011 More
2011/0004339 A1 1/2011 Ozick
2011/0010873 A1 1/2011 Kim
2011/0077802 A1 3/2011 Halloran
2011/0082668 A1 4/2011 Escrig
2011/0088609 A1 4/2011 Vosburgh
2011/0109549 A1 5/2011 Robbins
2011/0125323 A1 5/2011 Gutmann et al.
2011/0131741 A1 6/2011 Jones
2011/0154589 A1 6/2011 Reindle
2011/0202175 A1 8/2011 Romanov
2011/0209726 A1 9/2011 Dayton
2011/0252594 A1 10/2011 Blouin
2011/0258789 A1 10/2011 Lavabre
2011/0271469 A1 11/2011 Ziegler
2011/0277269 A1 11/2011 Kim
2011/0286886 A1 11/2011 Luchinger
2011/0288684 A1 11/2011 Farlow
2012/0011668 A1 1/2012 Schnittman
2012/0011669 A1 1/2012 Schnittman
2012/0011676 A1 1/2012 Jung
2012/0011677 A1 1/2012 Jung
2012/0011992 A1 1/2012 Rudakevych
2012/0036659 A1 2/2012 Ziegler
2012/0047676 A1 3/2012 Jung
2012/0049798 A1 3/2012 Cohen
2012/0079670 A1 4/2012 Yoon
2012/0083924 A1 4/2012 Jones
2012/0084934 A1 4/2012 Li
2012/0084937 A1 4/2012 Won
2012/0084938 A1 4/2012 Fu
2012/0085368 A1 4/2012 Landry
2012/0090133 A1 4/2012 Kim
2012/0095619 A1 4/2012 Pack
2012/0096656 A1 4/2012 Jung
2012/0097783 A1 4/2012 Pack
2012/0101661 A1 4/2012 Phillips
2012/0102670 A1 5/2012 Jang
2012/0109423 A1 5/2012 Pack
2012/0110755 A1 5/2012 Liu
2012/0118216 A1 5/2012 Vosburgh
2012/0125363 A1 5/2012 Kim
2012/0137464 A1 6/2012 Thatcher
2012/0137949 A1 6/2012 Vosburgh
2012/0151709 A1 6/2012 Tang
2012/0152280 A1 6/2012 Bosses
2012/0152877 A1 6/2012 Tadayon
2012/0159725 A1 6/2012 Kapoor
2012/0166024 A1 6/2012 Phillips
2012/0167917 A1 7/2012 Gilbert
2012/0169497 A1 7/2012 Schnittman
2012/0173018 A1 7/2012 Allen
2012/0173070 A1 7/2012 Schnittman
2012/0180254 A1 7/2012 Morse
2012/0180712 A1 7/2012 Vosburgh
2012/0181099 A1 7/2012 Moon
2012/0182392 A1 7/2012 Kearns
2012/0183382 A1 7/2012 Couture
2012/0185091 A1 7/2012 Field
2012/0185094 A1 7/2012 Rosenstein
2012/0185095 A1 7/2012 Rosenstein
2012/0185096 A1 7/2012 Rosenstein
2012/0192898 A1 8/2012 Lynch
2012/0194395 A1 8/2012 Williams
2012/0197439 A1 8/2012 Wang
2012/0197464 A1 8/2012 Wang
2012/0199006 A1 8/2012 Swett
2012/0199407 A1 8/2012 Morey
2012/0200149 A1 8/2012 Rudakevych
2012/0222224 A1 9/2012 Yoon
2012/0246862 A1 10/2012 Landry
2012/0260443 A1 10/2012 Lindgren
2012/0260861 A1 10/2012 Lindgren
2012/0261204 A1 10/2012 Won
2012/0265346 A1 10/2012 Gilbert
2012/0265391 A1 10/2012 Letsky
2012/0268587 A1 10/2012 Robbins
2012/0281829 A1 11/2012 Rudakevych
2012/0298029 A1 11/2012 Vosburgh
2012/0303160 A1 11/2012 Ziegler
2012/0311810 A1 12/2012 Gilbert
2012/0312221 A1 12/2012 Vosburgh
2012/0317745 A1 12/2012 Jung
2012/0322349 A1 12/2012 Josi
2013/0015596 A1 1/2013 Mozeika
2013/0025085 A1 1/2013 Kim
2013/0031734 A1 2/2013 Porat
2013/0032078 A1 2/2013 Yahnker
2013/0035793 A1 2/2013 Neumann
2013/0047368 A1 2/2013 Tran
2013/0054029 A1 2/2013 Huang
2013/0054129 A1 2/2013 Wong
2013/0060357 A1 3/2013 Li
2013/0060379 A1 3/2013 Choe
2013/0070563 A1 3/2013 Chiappetta
2013/0081218 A1 4/2013 Kim
2013/0085603 A1 4/2013 Chiappetta
2013/0086760 A1 4/2013 Han
2013/0092190 A1 4/2013 Yoon
2013/0098402 A1 4/2013 Yoon et al.
2013/0103194 A1 4/2013 Jones
2013/0105233 A1 5/2013 Couture
2013/0117952 A1 5/2013 Schnittman
2013/0118524 A1 5/2013 Konandreas
2013/0138337 A1 5/2013 Pack
2013/0145572 A1 6/2013 Schregardus
2013/0152724 A1 6/2013 Mozeika
2013/0160226 A1 6/2013 Lee
2013/0166107 A1 6/2013 Robbins
2013/0174371 A1 7/2013 Jones
2013/0204463 A1 8/2013 Chiappetta
2013/0204465 A1 8/2013 Phillips
2013/0204483 A1 8/2013 Sung
2013/0205520 A1 8/2013 Kapoor
2013/0206170 A1 8/2013 Svendsen
2013/0206177 A1 8/2013 Burlutskiy
2013/0211589 A1 8/2013 Landry

(56) References Cited

U.S. PATENT DOCUMENTS

| | | | | |
|---|---|---|---|---|
| 2013/0214498 | A1 | 8/2013 | DeFazio | |
| 2013/0226344 | A1 | 8/2013 | Wong | |
| 2013/0227801 | A1 | 9/2013 | Kim | |
| 2013/0227812 | A1 | 9/2013 | Kim | |
| 2013/0228198 | A1 | 9/2013 | Hung et al. | |
| 2013/0228199 | A1 | 9/2013 | Hung | |
| 2013/0231779 | A1 | 9/2013 | Purkayastha | |
| 2013/0231819 | A1 | 9/2013 | Hung | |
| 2013/0232702 | A1 | 9/2013 | Baek | |
| 2013/0239870 | A1 | 9/2013 | Hudson | |
| 2013/0241217 | A1 | 9/2013 | Hickey | |
| 2013/0253701 | A1 | 9/2013 | Halloran | |
| 2013/0256042 | A1 | 10/2013 | Rudakevych | |
| 2013/0268118 | A1 | 10/2013 | Grinstead | |
| 2013/0269148 | A1 | 10/2013 | Chiu | |
| 2013/0273252 | A1 | 10/2013 | Miyamoto | |
| 2013/0298350 | A1 | 11/2013 | Schnittman | |
| 2013/0310978 | A1 | 11/2013 | Ozick | |
| 2013/0325178 | A1 | 12/2013 | Jones | |
| 2013/0331987 | A1 | 12/2013 | Karlsson | |
| 2013/0338525 | A1 | 12/2013 | Allen | |
| 2013/0338828 | A1 | 12/2013 | Chiappetta | |
| 2013/0338831 | A1 | 12/2013 | Noh et al. | |
| 2013/0340201 | A1* | 12/2013 | Jang | A47L 9/009 15/319 |
| 2014/0016469 | A1 | 1/2014 | Ho | |
| 2014/0026338 | A1* | 1/2014 | Kim | A47L 11/4041 15/49.1 |
| 2014/0026339 | A1 | 1/2014 | Konandreas | |
| 2014/0053351 | A1 | 2/2014 | Kapoor | |
| 2014/0109339 | A1 | 4/2014 | Won | |
| 2014/0123325 | A1 | 5/2014 | Jung | |
| 2014/0130272 | A1 | 5/2014 | Won | |
| 2014/0142757 | A1 | 5/2014 | Ziegler | |
| 2014/0167931 | A1 | 6/2014 | Lee | |
| 2014/0180968 | A1 | 6/2014 | Song | |
| 2014/0207280 | A1 | 7/2014 | Duffley | |
| 2014/0207281 | A1 | 7/2014 | Angle | |
| 2014/0207282 | A1 | 7/2014 | Angle | |
| 2014/0238440 | A1 | 8/2014 | Dayton | |
| 2014/0249671 | A1 | 9/2014 | Halloran | |
| 2014/0283326 | A1 | 9/2014 | Song | |
| 2015/0005937 | A1 | 1/2015 | Ponulak | |
| 2015/0032259 | A1 | 1/2015 | Kim et al. | |
| 2015/0033488 | A1 | 2/2015 | Varila | |
| 2015/0039127 | A1 | 2/2015 | Matsumoto | |
| 2015/0057800 | A1 | 2/2015 | Cohen | |
| 2015/0120058 | A1 | 4/2015 | Noh et al. | |
| 2015/0185322 | A1 | 7/2015 | Haegermarck | |
| 2015/0197012 | A1 | 7/2015 | Schnittman | |
| 2015/0206015 | A1 | 7/2015 | Ramalingam et al. | |
| 2015/0265122 | A1 | 9/2015 | Han et al. | |
| 2016/0202703 | A1 | 7/2016 | Matsubara | |
| 2016/0306359 | A1 | 10/2016 | Lindhe | |
| 2016/0316982 | A1* | 11/2016 | Kim | A47L 9/2857 |
| 2017/0273521 | A1* | 9/2017 | Klintemyr | A47L 9/04 |
| 2017/0273524 | A1 | 9/2017 | Klintemyr et al. | |
| 2018/0103812 | A1* | 4/2018 | Lee | A47L 9/0653 |

FOREIGN PATENT DOCUMENTS

| | | | | |
|---|---|---|---|---|
| CN | 1668238 | A | 9/2005 | |
| CN | 101161174 | A | 4/2008 | |
| CN | 101297267 | A | 10/2008 | |
| CN | 102083352 | A | 6/2011 | |
| CN | 103027634 | | 4/2013 | |
| CN | 103054516 | A | 4/2013 | |
| CN | 103491838 | A | 1/2014 | |
| CN | 103565373 | A | 2/2014 | |
| DE | 3536907 | | 4/1986 | |
| DE | 9307500 | | 7/1993 | |
| DE | 4211789 | | 10/1993 | |
| DE | 4340367 | | 6/1995 | |
| DE | 4439427 | A1 * | 5/1996 | A47L 5/28 |
| DE | 19849978 | | 5/2000 | |
| DE | 202008017137 | U1 | 3/2009 | |
| DE | 102010000174 | | 7/2011 | |
| DE | 102010000573 | | 9/2011 | |
| DE | 102010037672 | | 3/2012 | |
| EP | 0142594 | | 5/1985 | |
| EP | 0358628 | | 3/1990 | |
| EP | 0474542 | | 3/1992 | |
| EP | 0569984 | | 11/1993 | |
| EP | 0606173 | | 7/1994 | |
| EP | 1099143 | | 11/2003 | |
| EP | 1360922 | A2 | 11/2003 | |
| EP | 1441271 | | 7/2004 | |
| EP | 1331537 | | 8/2005 | |
| EP | 2050380 | | 4/2009 | |
| EP | 1969438 | | 9/2009 | |
| EP | 1395888 | | 5/2011 | |
| EP | 2316322 | | 5/2011 | |
| EP | 2296005 | | 6/2011 | |
| EP | 2251757 | | 11/2011 | |
| EP | 2417894 | | 2/2012 | |
| EP | 2438843 | | 4/2012 | |
| EP | 2466411 | A2 | 6/2012 | |
| EP | 2561787 | | 2/2013 | |
| EP | 2578125 | | 4/2013 | |
| EP | 2583609 | | 4/2013 | |
| EP | 2604163 | | 6/2013 | |
| EP | 2447800 | | 4/2014 | |
| EP | 2741483 | | 6/2014 | |
| EP | 2772815 | | 9/2014 | |
| EP | 2884364 | A1 | 6/2015 | |
| EP | 2992803 | A1 | 3/2016 | |
| FR | 2999410 | | 6/2014 | |
| GB | 2355523 | | 4/2001 | |
| GB | 2382251 | | 5/2003 | |
| GB | 2494446 | | 3/2013 | |
| GB | 1447943 | | 10/2013 | |
| JP | 5540959 | | 3/1980 | |
| JP | 6286414 | | 4/1987 | |
| JP | 62109528 | | 5/1987 | |
| JP | 62120510 | | 6/1987 | |
| JP | 62152421 | | 7/1987 | |
| JP | 62152424 | | 7/1987 | |
| JP | 63127310 | A | 5/1988 | |
| JP | 63181727 | | 7/1988 | |
| JP | 63241610 | | 10/1988 | |
| JP | 03162814 | A | 7/1991 | |
| JP | 03166074 | | 7/1991 | |
| JP | 04260905 | | 9/1992 | |
| JP | 0584200 | | 4/1993 | |
| JP | 0584210 | | 4/1993 | |
| JP | 05084200 | | 4/1993 | |
| JP | 05189041 | | 7/1993 | |
| JP | 05224745 | | 9/1993 | |
| JP | 05228090 | | 9/1993 | |
| JP | 064133 | | 1/1994 | |
| JP | 0683442 | A | 3/1994 | |
| JP | 06125861 | | 5/1994 | |
| JP | 06144215 | | 5/1994 | |
| JP | 06179145 | | 6/1994 | |
| JP | 075922 | | 1/1995 | |
| JP | 0759695 | | 3/1995 | |
| JP | 0732752 | B2 | 4/1995 | |
| JP | 07129239 | A | 5/1995 | |
| JP | 07281742 | | 10/1995 | |
| JP | 08089455 | | 4/1996 | |
| JP | 08326025 | | 12/1996 | |
| JP | 0944240 | | 2/1997 | |
| JP | 09150741 | | 6/1997 | |
| JP | 09185410 | | 7/1997 | |
| JP | 11267074 | | 10/1999 | |
| JP | 2001022443 | | 1/2001 | |
| JP | 2001187009 | | 7/2001 | |
| JP | 2002182742 | A | 6/2002 | |
| JP | 2002267824 | A | 10/2002 | |
| JP | 2002355204 | | 12/2002 | |
| JP | 2002366228 | | 12/2002 | |
| JP | 2003280740 | | 10/2003 | |
| JP | 2004096253 | | 3/2004 | |

(56) References Cited

FOREIGN PATENT DOCUMENTS

| | | | |
|---|---|---|---|
| JP | 2004166968 | | 6/2004 |
| JP | 2004198212 | | 7/2004 |
| JP | 2004303134 | A | 10/2004 |
| JP | 2005040597 | A | 2/2005 |
| JP | 2005124753 | A | 5/2005 |
| JP | 2005141636 | A | 6/2005 |
| JP | 2005314116 | A | 11/2005 |
| JP | 2006015113 | A | 1/2006 |
| JP | 2006087507 | | 4/2006 |
| JP | 2006185438 | A | 7/2006 |
| JP | 2006231477 | | 9/2006 |
| JP | 2006314669 | | 11/2006 |
| JP | 2007014369 | A | 1/2007 |
| JP | 2007070658 | | 3/2007 |
| JP | 2007143645 | A | 6/2007 |
| JP | 2007213236 | A | 8/2007 |
| JP | 2007226322 | A | 9/2007 |
| JP | 2007272665 | A | 10/2007 |
| JP | 2008132299 | A | 6/2008 |
| JP | 2008146617 | A | 6/2008 |
| JP | 2008290184 | | 12/2008 |
| JP | 2008543394 | A | 12/2008 |
| JP | 2009500741 | A | 1/2009 |
| JP | 2009509220 | | 3/2009 |
| JP | 2009193240 | A | 6/2009 |
| JP | 2010507169 | A | 3/2010 |
| JP | 2010079869 | A | 4/2010 |
| JP | 2010526594 | | 8/2010 |
| JP | 2010534825 | A | 11/2010 |
| JP | 2011045694 | | 3/2011 |
| JP | 2011253361 | A | 12/2011 |
| JP | 2012216051 | A | 11/2012 |
| JP | 2013041506 | A | 2/2013 |
| JP | 2013089256 | A | 5/2013 |
| JP | 2013247986 | A | 12/2013 |
| JP | 2014023930 | A | 2/2014 |
| KR | 20040096253 | | 11/2004 |
| KR | 20050003112 | | 1/2005 |
| KR | 20070070658 | | 7/2007 |
| KR | 20090028359 | | 3/2009 |
| KR | 101231932 | | 3/2013 |
| NL | 7408667 | | 1/1975 |
| WO | 8804081 | | 6/1988 |
| WO | 9303399 | | 2/1993 |
| WO | 9638770 | | 12/1996 |
| WO | 0036961 | | 6/2000 |
| WO | 0036970 | | 6/2000 |
| WO | 0038025 | | 6/2000 |
| WO | 0182766 | A2 | 11/2001 |
| WO | 03022120 | | 3/2003 |
| WO | 03024292 | | 3/2003 |
| WO | 03026474 | A2 | 4/2003 |
| WO | 2004006034 | A2 | 1/2004 |
| WO | 2004082899 | | 9/2004 |
| WO | 2007008148 | | 1/2007 |
| WO | 2007028049 | | 3/2007 |
| WO | 2007051972 | | 5/2007 |
| WO | 2007065034 | | 6/2007 |
| WO | 2008048260 | | 4/2008 |
| WO | 2009132317 | | 10/2009 |
| WO | 2013105431 | | 7/2013 |
| WO | 2013157324 | | 10/2013 |
| WO | 2014033055 | | 3/2014 |
| WO | 2014151501 | A1 | 9/2014 |
| WO | 2015016580 | | 2/2015 |

OTHER PUBLICATIONS

Final Office Action for U.S. Appl. No. 15/102,017, dated Jun. 14, 2018, 12 pages.
Non Final Office Action for U.S. Appl. No. 15/101,235, dated Jun. 14, 2018, 11 pages.
Chinese Office Action for Chinese Application No. 201380081331.6, dated Mar. 26, 2018 with translation, 27 pages.
Decision of Refusal for Japanese Application No. 2016-526945, dated May 15, 2018 with translation, 5 pages.
Decision of Refusal for Japanese Application No. 2016-526875, dated May 15, 2018 with translation, 6 pages.
Notification of Reasons for Refusal for Japanese Application No. 2016-526765, dated May 15, 2018 with translation, 6 pages.
International Search Report and Written Opinion for International Application No. PCT/EP2015/070140, dated May 27, 2016, 11 pages.
European Communication Pursuant to Article 94(3) for European Application No. 13817911.4, dated Jan. 15, 2018, 8 pages.
Non Final Office Action for U.S. Appl. No. 15/102,017, dated Feb. 16, 2018, 12 pages.
Non Final Office Action for U.S. Appl. No. 15/101,212, dated May 17, 2017, 8 pages.
Japanese Office Action forApplication for Japanese Application No. 2015-528969, dated Apr. 7, 2017 with translation, 4 pages.
Final Office Action for U.S. Appl. No. 14/409,291, dated Jun. 6, 2017, 21 pages.
International Search Report and Written Opinion for International Application No. PCT/EP2016/055547, dated Jan. 2, 2017, 10 pages.
Notice of Allowance for U.S. Appl. No. 15/100,667,dated Aug. 6, 2018, 10 pages.
Non Final Office Action for U.S. Appl. No. 15/101,510, dated Jul. 27, 2018, 17 pages.
Chinese Office Action for Chinese Application No. 201380081537.9, dated Jun. 4, 2018 with translation, 15 pages.
Non Final Office Action for U.S. Appl. No. 14/784,110, dated Aug. 16, 2018, 13 pages.
Non Final Office Action for U.S. Appl. No. 15/101,235, dated Nov. 1, 2017, 11 pages.
Non Final Office Action for U.S. Appl. No. 15/100,667, dated Nov. 29, 2017, 22 pages.
Non Final Office Action for U.S. Appl. No. 14/784,106, dated Oct. 19, 2017, 11 pages.
Final Office Action for U.S. Appl. No. 15/101,212, dated Oct. 11, 2017, 7 pages.
Chinese Office Action for Chinese Application No. 201380075510.9, dated Oct. 27, 2017 with translation, 13 pages.
Notification of Reasons for Refusal for Japanese Application No. 2016-526945, dated Oct. 31, 2017 with translation, 8 pages.
Notification of Reasons for Refusal for Japanese Application No. 2016-526875, dated Oct. 31, 2017 with translation, 10 pages.
Notice of Reasons for Rejection for Japanese Application No. 2016-526947, dated Sep. 21, 2017 with translation, 8 pages. 2017.
Notice of Allowance for U.S. Appl. No. 15/102,015, dated Dec. 11, 2017, 8 pages.
"SM51 Series Opposed Mode Sensors, DC sensors with metal housings: SM51EB/RB, SM51EB6/RB6", Banner Engineering Corporation, pp. 1-24.
Andersson, et al., "ISR: An Intelligent Service Robot", Centre for Autonomous Systems, Royal Institute of Technology, S-100 44 Stockholm, Sweden, pp. 1-24.
Berlin, et al. "Development of a Multipurpose Mobile Robot for Concrete Surface Processing", A Status Report, Feb. 1992, Sweden, pp. 1-10.
Borenstein, et al. "Real-Time Obstacle Avoidance for Fast Mobile Robots", IEEE, Jan. 6, 1996, pp. 1-18.
Braunstingl, et al., "Fuzzy Logic Wall Following of a Mobile Robot Based on the Concept of General Perception", ICAR '95, 7th International Conference on Advanced Robotics, Sant Feliu De Guixols, Spain pp. 367-376., Sep. 1995, pp. 1-9.
Caselli, et al. "Mobile Robot Navigation in Enclosed Large-Scale Space", Italy and U.S.A., pp. 1-5.
Cassens, et al. "Finishing and Maintaining Wood Floors", Wood Finishing, North Central Regional Extension Publication #136, pp. 1-8.
Chinese Office Action for Chinese Application No. 20130075510.9, dated Feb. 6, 2017 with translation, 14pages.
Chinese Office Action for Chinese Application No. 201380075503.9, dated Feb. 13, 2017 with translation, 18 pages.

(56) References Cited

OTHER PUBLICATIONS

Chung etal.,"Path Planning for a Mobile Robot With Grid Type World Model", Proceedings of the 1992 IEEE/RSJ International Conference on Intelligent Robots and Systems,Jul. 7-10, 1992, pp. 439-444.
Collins, et al. "Cerebellar Control of a Line Following Robot", Computer Science and Electrical Engineering Department, University of Queensland, St.Lucia, Queensland, 4072 A, pp. 1-6.
Doty, et al. "Sweep Strategies for a Sensory-Driven, Behavior-Based Vacuum Cleaning Agent", 1993, Machine Intelligence Laboratory—Gainesville Florida, AAAI 1993 Fall Symposium Series—Research Triangle Park—Raleigh, NC, Oct. 22-24, 1993, pp. 1-6.
Everett, Sensors for Mobile Robots Theory and Application, A.K. Peters, 1995, Chapters 1 and 3, 70pages.
Everett, Sensors for Mobile Robots Theory and Application, A.K. Peters, Ltd., 1995, Chapters 15 and 16, 59pages.
Everett, Sensors for Mobile Robots Theory and Application, A.K. Peters, Ltd., 1995, Chapters 6, 7 and 10, 79pages.
Everett, Sensors for Mobile Robots Theory and Application, A.K. Peters, Ltd., 1995, Chapters, 4a nd 5, 68pages.
Everett, et al. "Survey of Collision Avoidance and Ranging Sensors for Mobile Robots", Revision 1, Technical Report 1194, Dec. 1992, pp. 1-154.
Extended European Search Report for European Application No. 16176479.0, dated Nov. 11, 2016, 9pages.
Final Office Action for U.S. Appl. No. 15/100,667, dated Apr. 21, 2017, 26 pages.
Gavrilut, et al., "Wall-Following Method for an Autonomous Mobile Robot using Two IR Sensors", 12th WSEAS International Conference on Systems, Heraklion, Greece, Jul. 22-24, 2008, ISBN: 978-960-6766-83-1, ISSN: 1790-2769, pp. 205-209.
Herbst, et al., "Micromouse Design Specifications", Jun. 2, 1998, pp. 1-22.
International Preliminary Report on Patentability for International Application No. PCT/EP2013/077377, dated Jun. 21, 2016, 12 pages.
International Preliminary Report on Patentability for International Application No. PCT/EP2013/077378, dated Jun. 21, 2016, 7 pages.
International Preliminary Report on Patentability for International Application No. PCT/EP2013/077384, dated Jun. 21, 2016, 6 pages.
International Preliminary Report on Patentability for International Application No. PCT/EP2013/077385, dated Jun. 21, 2016, 7 pages.
International Preliminary Report on Patentability for International Application No. PCT/EP2013/077386, dated Jun. 21, 2016, 6 pages.
International Preliminary Report on Patentability for International Application No. PCT/EP2013/077387, dated Jun. 21, 2016, 9 pages.
International Preliminary Report on Patentability for International Application No. PCT/EP2013/077657, dated Jun. 21, 2016, 7 pages.
International Preliminary Report on Patentability for International Application No. PCT/EP2013/077661, dated Jun. 21, 2016, 11 pages.
International Preliminary Report on Patentability for International Application No. PCT/EP203/077380, dated Jun. 21, 2016, 6 pages.
International Search Report and Written Opinion of the International Searching Authority fo International Applicaion No. PCT/EP2014/0077142, dated Sep. 11, 2015, 8 pages.
International Search Report and Written Opinion of the International Searching Authority for International Application No. PCT/EP2014/069073, dated May 12, 2015, 10pages.
International Search Report and Written Opinion of the International Searching Authority for International Application No. PCT/Ep2012/077377, dated Nov. 6, 2014, 18 pages.
International Search Report and Written Opinion of the International Searching Authority for International Application No. PCT/EP2013/077378, dated Apr. 9, 2014, 9 pages.
International Search Report and Written Opinion of the International Searching Authority for International Application No. PCT/EP2013/077380, dated Jul. 28, 2014, 8 pages.
International Search Report and Written Opinion of the International Searching Authority for International Application No. PCT/EP2013/077384, dated Aug. 14, 2016, 9 pages.
International Search Report and Written Opinion of the International Searching Authority for International Application No. PCT/EP2013/077385, dated May 27, 2015, 9 pages.
International Search Report and Written Opinion of the International Searching Authority for International Application No. PCT/EP2013/077386, dated Sep. 17, 2014, 9 pages.
International Search Report and Written Opinion of the International Searching Authority for International Application No. PCT/EP2013/077387, dated Sep. 30, 2014, 12 pages.
International Search Report and Written Opinion of the International Searching Authority for International Application No. PCT/EP2013/077661, dated Jun. 10, 2014, 15 pages.
International Search Report and Written Opinion of the International Searching Authority for International Application No. PCT/EP2014/069074, dated May 11, 2015, 9 pages.
International Search Report and Written Opinion of the International Searching Authority for International Application No. PCT/EP2014/077549, dated Jul. 27, 2015, 9 pages.
International Search Report and Written Opinion of the International Searching Authority for International Application No. PCT/EP2014/077947, dated Jul. 11, 2016, 14 pages.
International Search Report and Written Opinion of the International Searching Authority for International Application No. PCT/EP2014/077954, dated Oct. 12, 2015, 19pages.
International Search Report and Written Opinion of the International Searching Authority for International Application No. PCT/EP2014/078144, 7 pages.
International Search Report and Written Opinion of the International Searching Authority for International Application No. PCT/EP32013/077657, dated Aug. 18, 2014, 10 pages.
International Search Report for International Application No. PCT/EP2013/057814 dated Dec. 20, 2013, 5pages.
International Search Report for International Application No. PCT/EP2013/057815 dated Apr. 12, 2014, 4 pages.
International Search Report for International Application No. PCT/EP2013/067500 dated Dec. 10, 2013, 4pages.
Japanese Office Action for Japanese Application No. 2016-506794, dated Feb. 7, 2017 with translation, 10 pages.
Japanese Office Action for Japanese Application No. 2016-506795 , dated Feb. 7, 2017 with translation, 6 pages.
Jenkins, "Practical Requirements for a Domestic Vacuum-Cleaning Robot", From: AAAI Technical Report FS-93-03., JRL Consulting, Menlo Park, California, pp. 85-90.
Jones et al., Mobile Robots Inspiration to Implementation, Second Edition, A.K. Peters, Ltd., 1999, Chapters 1 and 5, 72pages.
Jones etal., Mobile Robots Inspiration to Implementation, Second Edition, A.K. Peters ,Ltd., 1999, Chapters 6 and 9, 56pages.
Jones etal., Mobile Robots Inspiration to Implementation, Second Edition, A.K. Peters, Ltd., 1999, Chapters 10 and 11, 45pages.
Jung, et al. "Whisker Based Mobile Robot Navigation", Wollongong, NSW 2500, Australia, pp. 1-8.
Krishna, et al., "Solving the Local Minima Problem for a Mobile Robot by Classification of Spatio-Temporal Sensory Sequences", Journal of Robotic Systems 17 (10), 2000, pp. 549-564.
Kube, "A Minimal Infrared Obstacle Detection Scheme", Department of Computing Science, University of Alberta, Edmonton, Alberta, Canada, The Robotics Practitioner, 2(2): 15-20, 1996, Oct. 23, 1998, pp. 1-8.
Larson, "RoboKent—a case study in man-machine interfaces" Industrial Robot, vol. 25 No. 2, 1998, pp. 95-100.
LeBouthillier, "W. Grey Walter and his Turtle Robots", The Robot Builder, vol. Eleven No. Five, May 1999, RSSC POB 26044, Santa Ana,CA, pp. 1-8.
Maaref,etal."Sensor-based navigation of a mobile robot in an indoor environment", Robotics and Autonomous Systems, 2002, Elsevier, 18pages.
Michael Carsten Bosse, "Atlas: A Framework for Large Scale Automated Mapping and Localization", Massachusetts Institute of Technology, Feb. 2004, Part 2, 67 pages.

(56) References Cited

OTHER PUBLICATIONS

Michael Carsten Bosse, "Atlas: A Framework for Large Scale Automated Mapping and Localization", Massachusetts Institute of Technology, Feb. 2004, Part 1, 140 pages.
Non Final Office Action for U.S. Appl. No. 14/409,291, dated Dec. 28, 2016, 61pages.
Non Final Office Action for U.S. Appl. No. 15/100,667, dated Sep. 12, 2016, 24 pages.
Non Final Office Action for U.S. Appl. No. 15/101,235 dated Apr. 21, 2017, 10 pages.
Non Final Office Action for U.S. Appl. No. 15/101,257, dated Feb. 10, 2017, 10 pages.
Notice of Allowance for U.S. Appl. No. 14/409,291, dated Jun. 16, 2016, 13 pages.
Oren, Reply to Office Action dated Jun. 23, 2014, U.S. Appl. No. 13/757,985, pp. 1-10.
Pack, et al., "Constructing a Wall-Follower Robot for a Senior Design Project", 1996 ASEE Annual Conference Proceedings, Session 1532, pp. 1-7.
Saffiotti, "Fuzzy logic in Autonomous Robot Navigation", a case study, Nov. 1995 Revised: Aug. 1997, IRIDIA, Universite Libre de Bruxelles, Belgium, Technical Report TR/IRIDIA/ 95 25, Cover page + pp. 1-14.
Written Opinion for International Application No. PCT/EP2013/067500 dated Dec. 10, 2013, 7pages.
Yamamoto, "SOZZY: A Hormone-Driven Autonomous Vacuum Cleaner", From: AAAI Technical Report FS-93-03, Matasushita Research Institute, Tokyo, and MIT Artificial Intelligence laboratory, Massachusetts, pp. 116-124 + Figure 9 and Figure 11.
Notice of Allowance for U.S. Appl. No. 15/101,257, dated Jul. 6, 2017, 9 pages.
International Search Report and Written Opinion of the International Searching Authority for International Application No. PCT/EP2015/058377, dated Aug. 10, 2016, 15 pages.
Non Final Office Action for U.S. Appl. No. 15/102,015, dated Aug. 17, 2017, 13 pages.
Chinese Office Action for Chinese Application No. 201380075503.9, dated Nov. 8, 2017 with translation, 16 pages.
European Communication Pursuant to Article 94(3) for European Application No. 16176479.0, dated Nov. 27, 2017, 6 pages.
Notice of Allowance for U.S. Appl. No. 14/409,291, dated Sep. 18, 2017, 8 pages.
Notice of Reasons for Rejection for Japanese Application No. 2016-526764, dated Aug. 25, 2017 with translation, 6 pages.
Notification to Reasons for Rejection for Japanese Application No. 2016-526765, dated Aug. 25, 2017 with translation, 7 pages.
Notification of Reasons for Refusal for Japanese Application No. 2016-526756, dated Aug. 10, 2017 with translation, 6 pages.
Notification of Reasons for Refusal for Japanese Application No. 2016-526759, dated Aug. 24, 2017 with translation, 9 pages.
Non Final Office Action for U.S. Appl. No. 15/321,333, dated Oct. 24, 2018, 10 pages.
Position_Definition of Position by Merriam-Webster.pdf (Position | Definition of Position by Merriam-Webster, Oct. 16, 2018, Merriam-Webster, https://www.merriam-webster.com/dictionary/position, pp. 1-15.
Gutman et al., AMOS: Comparison of Scan Matching Approaches for Self-Localization in Indoor Environments, 1996, IEEE, pp. 61-67.
Notice of Allowance for U.S. Appl. No. 14/784,106, dated Oct. 11, 2018, 7 pages.
Non Final Office Action for U.S. Appl. No. 15/504,071, dated Nov. 2, 2018, 17 pages.
Extended European Search Report for European Application No. 18157403.9, dated Nov. 14, 2018, 12 pages.
Report of Reconsideration by Examiner before Appeal for Japanese Application No. 2016-526875, dated Oct. 24, 2018, 2 pages.
Notice of Allowance for U.S. Appl. No. 15/102,295, dated Sep. 24, 2018, 9 pages.
Notice of Allowance for U.S. Appl. No. 15/101,515, dated Aug. 28, 2018, 11 pages.
International Search Report and Written Opinion of the International Searching Authority for International Application No. PCT/EP2016/060565, dated Feb. 15, 2017, 12 pages.
International Search Report and Written Opinion of the International Searching Authority for International Application No. PCT/EP2016/060571, dated Feb. 7, 2017, 8 pages.
Notification of Reasons for Refusal of Japanese Application No. 2016-568949, dated Oct. 9, 2018 with translation, 6 pages.
International Search Report and Written Opinion of the International Searching Authority for International Application No. PCT/E2016/072291, dated Jun. 6, 2017, 11 pages.
Non Final Office Action for U.S. Appl. No. 15/102,017, dated Jan. 22, 2019, 15 pages.
Final Office Action for U.S. Appl. No. 15/101,510, dated Feb. 8, 2019, 16 pages.
Final Office Action for U.S. Appl. No. 15/101,235, dated Jan. 11, 2019, 12 pages.
Final Office Action for U.S. Appl. No. 15/504,071, dated Mar. 5, 2019, 20 pages.
Notice of Allowance for U.S. Appl. No. 15/101,510, dated May 30, 2019, 12 pages.
Chinese Office Action for Chinese Application No. 20130081103.9, dated Jun. 6, 2019 with translation, 10 pages.
Non Final Office Action for U.S. Appl. No. 15/101,515, dated Apr. 18, 2018, 14 pages.
Notice of Allowance for U.S. Appl. No. 15/101,212, dated Apr. 11, 2018, 9 pages.
Final Office Action for U.S. Appl. No. 14/784,106, dated Mar. 28, 2018, 8 pages.
Final Office Action for U.S. Appl. No. 15/100,667, dated Mar. 27, 2018, 23 pages.
Notification of Reasons for Refusal for Japanese Application No. 2017-501374, dated Mar. 6, 2018 with translation, 8 pages.
Chinese Office Action for Chinese Application No. 201380081535.X, dated Mar. 26, 2018 with translation, 18 pages.
Chinese Office Action for Chinese Application No. 201380081103.9, dated Feb. 27, 2018 with translation, 19 pages.
Non Final Office Action for U.S. Appl. No. 15/534,591, dated Aug. 9, 2019, 11 pages.
Non Final Office Action for U.S. Appl. No. 15/504,071, dated Aug. 8, 2019, 23 pages. 2.

* cited by examiner

ROBOTIC VACUUM CLEANER

This application is a U.S. National Phase application of PCT International Application No. PCT/EP2014/069073, filed Sep. 8, 2014, which is incorporated by reference herein.

TECHNICAL FIELD

The present invention relates to a robotic vacuum cleaner.

BACKGROUND

A robotic vacuum cleaner forms of a self-propelling unit provided with a drive arrangement comprising a control system configured to control a movement of the robotic vacuum cleaner along a surface to be cleaned. The control system may comprise one or more sensors providing input to assist in controlling the movement of the robotic vacuum cleaner. A vacuum producing unit of the robotic vacuum cleaner is arranged in fluid communication with an opening of a nozzle inlet facing the surface to be cleaned. Debris sucked or otherwise propelled into the opening is directed into a debris receptacle of the robotic vacuum cleaner. The debris receptacle is emptied, or replaced, when filled with debris to a certain degree.

Since a robotic vacuum cleaner is to move freely about a surface to be cleaned it would be limited in its movements by an electric cord. Thus, a robotic vacuum cleaner is battery powered and the cleaning capability of a robotic vacuum cleaner has to be designed with the capacity of the on-board battery in mind. Accordingly, the drive arrangement, the capacity of the vacuum producing unit, the use of various rotating brushes, etc. affect consumption of electric power and thus, the design of a robotic vacuum cleaner.

Thus, the vacuum, or suction, produced by the vacuum producing unit should be produced with as low electric energy consumption as possible while maintaining good cleaning efficiency.

SUMMARY

It is an object of the present invention to provide a robotic vacuum cleaner having potential to produce a suction force sufficient to draw also larger debris than dust, such as sand and small stones, into the robotic vacuum cleaner with low energy consumption.

According to an aspect of the invention, the object is achieved by a robotic vacuum cleaner comprising a housing, a drive arrangement being configured to drive the vacuum cleaner along a surface to be cleaned, a vacuum producing unit, a debris receptacle, and a nozzle inlet arranged in a portion of the housing facing the surface to be cleaned. The nozzle inlet comprises a frame structure forming an opening, the opening being arranged in fluid communication with the debris receptacle and the vacuum producing unit being arranged in in fluid communication with the opening. The frame structure has a leading edge portion and opposite thereto a trailing edge portion, the leading edge portion and the trailing edge portion border to the opening. The frame structure comprises a base portion extending substantially in parallel with the surface to be cleaned, the base portion extending at a first level. The leading edge portion comprises at least two distance members forming there between a channel to the opening, the channel having a delimiting surface extending at a second level substantially in parallel with the first level. The first level is arranged closer to the surface to be cleaned than the second level. Each distance member has a substantially triangular cross section extending substantially in parallel with the first plane, the distance member extending between the first level and the second level with a top of the substantially triangular cross section facing outwardly from the opening and a base of the substantially triangular cross section extending in parallel with the opening. Side surfaces of the distance member extend substantially from the top to the base of the substantially triangular cross section, at least a portion of the side surfaces extending substantially perpendicularly to the base portion.

Since the nozzle inlet comprises the base portion extending at the first level and the channel formed between the distance members has the delimiting surface extending at the second level, a larger air flow is produced in the channel by the vacuum producing unit than at the base portion and the distance members at the first level. The larger airflow and space provided in the channel assists in drawing debris larger than dust into the opening while at the base portion the airflow is lower thus, saving electric energy. Moreover, the substantially triangular cross section of the distance members reduces the cross section of the channel towards the opening thus inducing an air speed, which gradually increases towards the opening. Further, due to the portion of the side surfaces extending substantially perpendicularly to the base portion, larger debris than dust such as sand and small stones, in the channel will be directed through the channel to the opening, and will not be caught between a top of an adjacent distance member, or between the base portion, and the surface to be cleaned, which could increase the distance between the robotic vacuum cleaner and the surface to be cleaned and disturbing the suction created around the nozzle inlet. As a result, the above mentioned object is achieved.

It is understood that the first level is arranged closer to the surface to be cleaned than the second level in use of the robotic vacuum cleaner. The robotic vacuum cleaner may be a self-propelling unit. The drive arrangement may comprise one or more wheels, of which at least one wheel is directly or indirectly driven by an electric drive motor. The drive arrangement may further comprise a control system configured to control the electric drive motor to move the robotic vacuum cleaner about the surface to be cleaned. The control system may comprise one or more sensors to provide input assisting in controlling the movement of the robotic vacuum cleaner. The at least one sensor may be of one or more different kinds, such as e.g. an infrared sensor, a laser sensor, an ultrasonic sensor, or a contact sensor. The vacuum producing unit may comprise a fan driven by an electric fan motor. The opening may be arranged in fluid communication with the debris receptacle via a debris conduit system. The vacuum producing unit may be arranged in fluid communication with the opening via the debris conduit system and optionally also the debris receptacle, i.e. the vacuum producing unit in some embodiments may create a suction from the opening of the nozzle inlet via the debris conduit system to the debris receptacle. In use of the robotic vacuum cleaner the leading edge portion of the frame structure travels ahead of the trailing edge portion in most cleaning situations. The robotic vacuum cleaner may comprise one or more rotatable brushes assisting in propelling debris towards, or into, the opening of the nozzle inlet. The rotatable brushes may be driven by one or more electric brush motors. Besides controlling the drive motor, the control system may also control the fan motor and/or the one or more brush motors. The robotic vacuum cleaner may comprise one or more rechargeable batteries configured to power the drive arrangement including the control system and the various electric motors.

According to embodiments, the first level may extends at distance of less than 2 mm from the surface to be cleaned. In this manner the vacuum producing unit may produce a substantial suction force in an area around the base portion of the frame structure, which base portion is arranged at the first level, and no protruding element, such as a resilient ridge, extending along a portion of the opening may be required to reduce the amount of air flowing into the opening. Moreover, with the first level extending at a distance of less than 2 mm from the surfaced to be cleaned, the larger air flow in the channel may be attained. It is understood that the first level may extend at a distance of less than 2 mm from the surface to be cleaned in use of the robotic vacuum cleaner. The distance between the first level and the surface to be cleaned is measured when the robotic vacuum cleaner is standing on a firm surface such as a hardwood flooring.

Mentioned purely as an example, a distance between the first and second levels may be between 1-8 mm.

According to embodiments, the base portion may be that part of the nozzle inlet which extends closest to the surface to be cleaned. In this manner the nozzle inlet may not require any protruding element, such as a resilient ridge, extending along a portion of the opening to produce sufficient suction in an area around the base portion.

According to embodiments, the nozzle inlet may form part of the housing or alternatively, may be attached to the housing, and wherein the base portion may extend closest to the surface to be cleaned of the nozzle inlet and the housing.

According to embodiments, a bottom surface of each of the distance members may form a smooth transition between the second level and the first level. Since the distance members are comprised in the leading edge portion of the frame structure, in this manner the leading edge portion may slide over a vertical transition of the surface to be cleaned, such as when the robotic vacuum cleaner transits from a bare floor surface onto a carpet or over a doorsill.

According to embodiments, the nozzle inlet may comprise at least one cross brace extending from at least one of the distance members to the trailing edge. In this manner elongated objects, such as cables, may be prevented from being caught in the opening.

According to embodiments, the at least one cross brace forms part of the base portion and extends at the first level. In this manner the cross brace may prevent the trailing edge from abutting, in the opening, against a vertical transition of the surface to be cleaned, such as a carpet edge. This could otherwise prevent the robotic vacuum cleaner from continuing traveling forwardly.

According to embodiments, the robotic vacuum cleaner may comprise a rotatable elongated brush roll arranged inside the housing and extending along the nozzle inlet, the rotatable elongated brush roll comprising radially extending members extending from inside the housing at least to the first level. In this manner the elongated brush roll may assist in propelling in particular larger debris, such as sand and small stones, into the opening.

According to embodiments, a first radially extending member of the radially extending members may comprise a resilient lip and a second radially extending member of the radially extending members may comprise bristles.

BRIEF DESCRIPTION OF THE DRAWINGS

Various aspects of the invention, including its particular features and advantages, will be readily understood from the example embodiments discussed in the following detailed description and the accompanying drawings, in which.

DETAILED DESCRIPTION

Aspects of the present invention will now be described more fully. Like numbers refer to like elements throughout. Well-known functions or constructions will not necessarily be described in detail for brevity and/or clarity.

Figure 1:
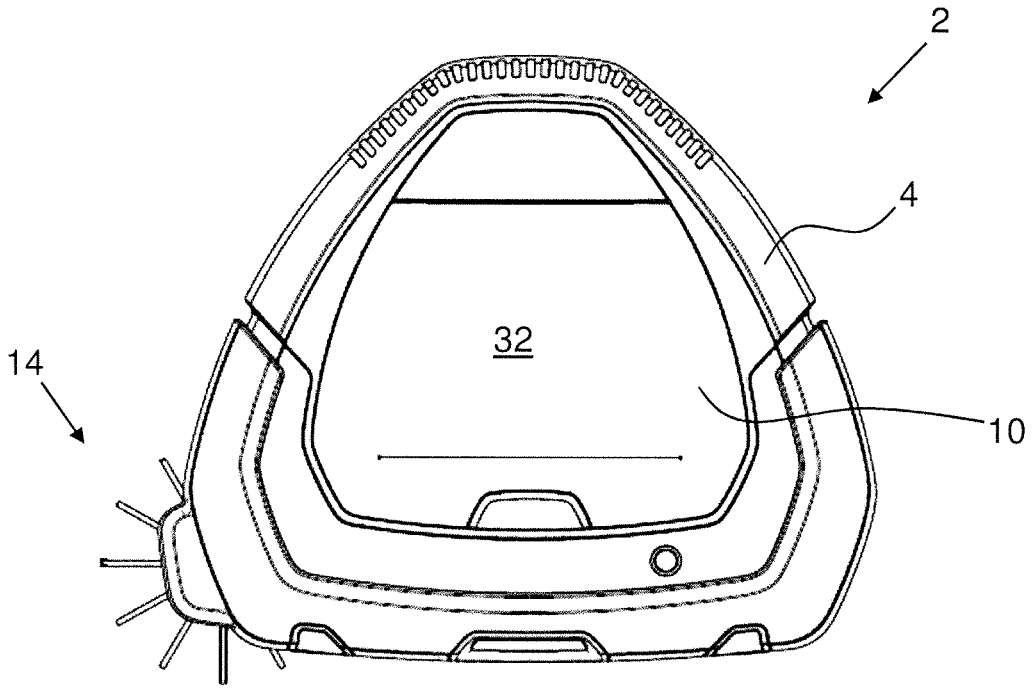
FIGS. 1 and 2 illustrate a top view and a perspective bottom view of a robotic vacuum cleaner according to embodiments.
Figure 2:
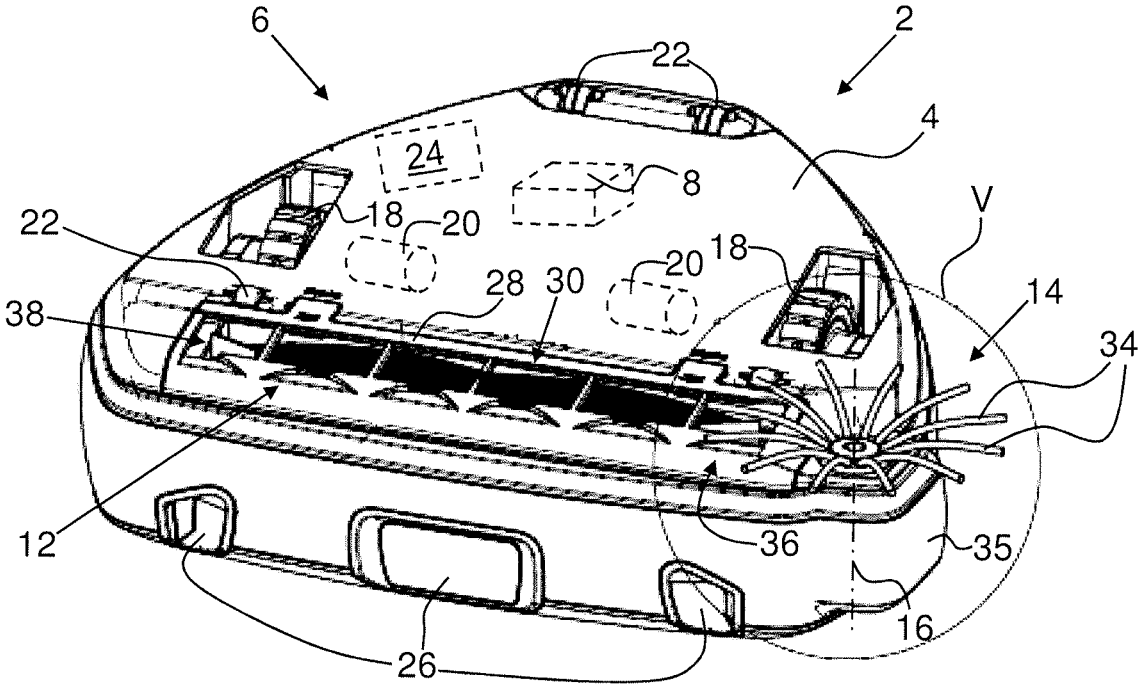

FIGS. 1 and 2 illustrate a top view and a perspective bottom view of a robotic vacuum cleaner 2 according to embodiments. The robotic vacuum cleaner 2 comprises a housing 4, a drive arrangement 6 configured to drive the vacuum cleaner 2 along a surface to be cleaned, a vacuum producing unit 8 (schematically illustrated), a debris receptacle 10, and a nozzle inlet 12 arranged in a portion of the housing 4 facing the surface to be cleaned.

The drive arrangement 6 ensures that the robotic vacuum cleaner is a self-propelling unit. The drive arrangement 6 comprises two wheels 18 driven by electric drive motors 20, (schematically illustrated). The drive arrangement 6 comprises non-driven supporting wheels 22. The drive arrangement 6 also comprises a control system 24 (schematically illustrated) configured to control the electric drive motors 20. The control system 24 comprises sensors 26 assisting in controlling the movement of the robotic vacuum cleaner 2.

The debris receptacle 10 is arranged in the housing 4. One side portion 32 of the debris receptacle 10 forms an outer surface portion of the robotic vacuum cleaner 2. Thus, the debris receptacle 10 is easily accessible and removable by a user for emptying thereof. The nozzle inlet 12 is elongated and extends in parallel with a rotation axis of the two driven wheels 18. Thus, the nozzle inlet extends across a travelling direction of the robotic vacuum cleaner 2 for broad cleaning coverage.

The nozzle inlet 12 comprises a frame structure 28 forming an opening 30. The opening 30 is arranged in fluid communication with the debris receptacle 10 and the vacuum producing unit 8 is arranged in fluid communication with the opening 30. Thus, the vacuum producing unit 8 may produce a suction force at the opening 30 to transport debris from an area around the opening 30 via a debris conduit system to the debris receptacle 10.

The robotic vacuum cleaner 2 comprises a rotatable side brush 14 comprising bristles 34 extending radially to a rotation axis 16 of the rotatable side brush 14 and extending substantially in parallel with the surface to be cleaned. The bristles 34 extend to, and beyond, a lateral portion 35 of the housing 4 and over a side portion 36 of the nozzle inlet 12. The bristles 34 have been illustrated schematically in FIG. 2. In practice the bristles 34 may be considerably thinner than illustrated and the rotatable side brush 14 may be provided with a considerably larger number of bristles 34 than illustrated. The robotic vacuum cleaner 2 comprises a rotatable elongated brush roll 38 arranged inside the housing 4 and extending along the nozzle inlet 12 including the side portion 36 of the nozzle inlet 12.

Figure 3:
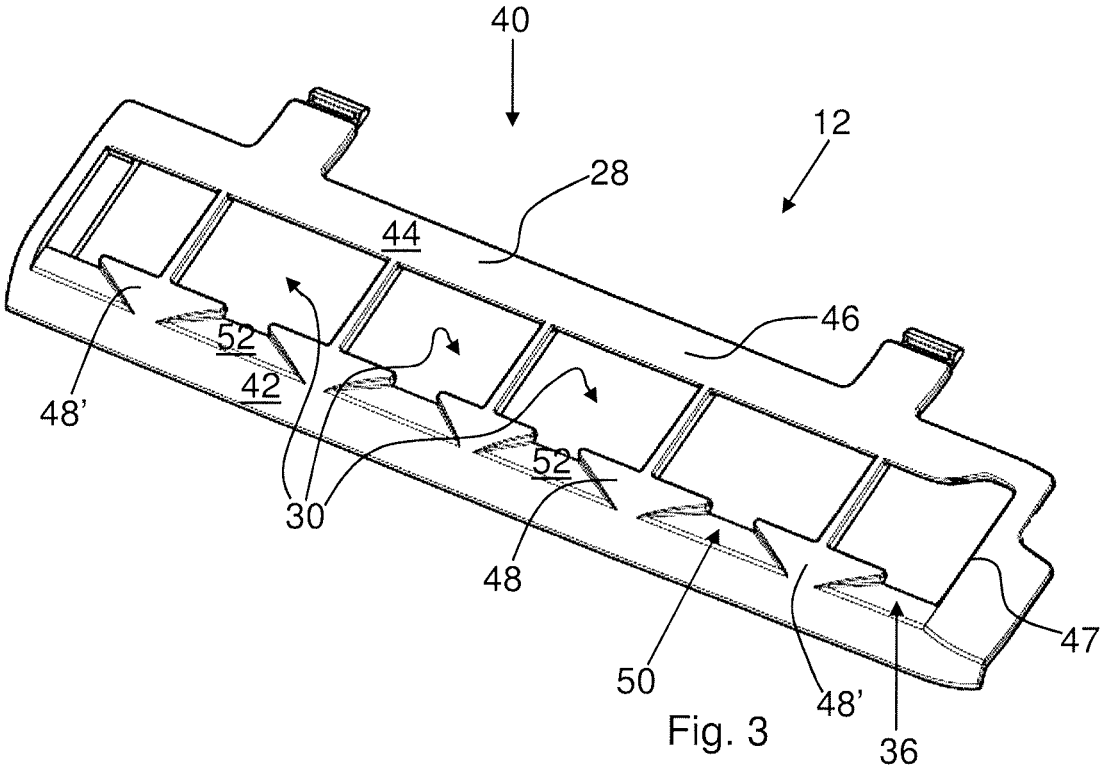
FIG. 3 illustrates a nozzle inlet of the robotic vacuum cleaner shown in FIG. 2.

FIG. 3 illustrates the nozzle inlet 12 of the robotic vacuum cleaner 2 shown in FIG. 2 in greater detail. In these embodiments, the nozzle inlet 12 is comprised in a removable lid 40 configured to be positioned in the housing of the robotic vacuum cleaner 2. In alternative embodiments, the nozzle inlet 12 may be formed directly in the housing.

As mentioned above, the nozzle inlet 12 comprises a frame structure 28 forming an opening 30. The frame structure 28 has a leading edge portion 42 and opposite thereto a trailing edge portion 44. The leading edge portion 42 and the trailing edge portion 44 border to the opening 30. The frame structure 28 comprises a base portion 46, which in use of the robotic vacuum cleaner extends substantially in parallel with the surface to be cleaned at a first level. The leading edge portion 42 comprises at least two distance members 48 forming there between a channel 50 to the opening 30. In these embodiments the leading edge portion 42 comprises five distance members 48, 48'. In alternative embodiments the leading edge portion may comprise less than five distance members, e.g. three or four distance members, or more than five distance members, e.g. 6-10 distance members.

Figure 4:
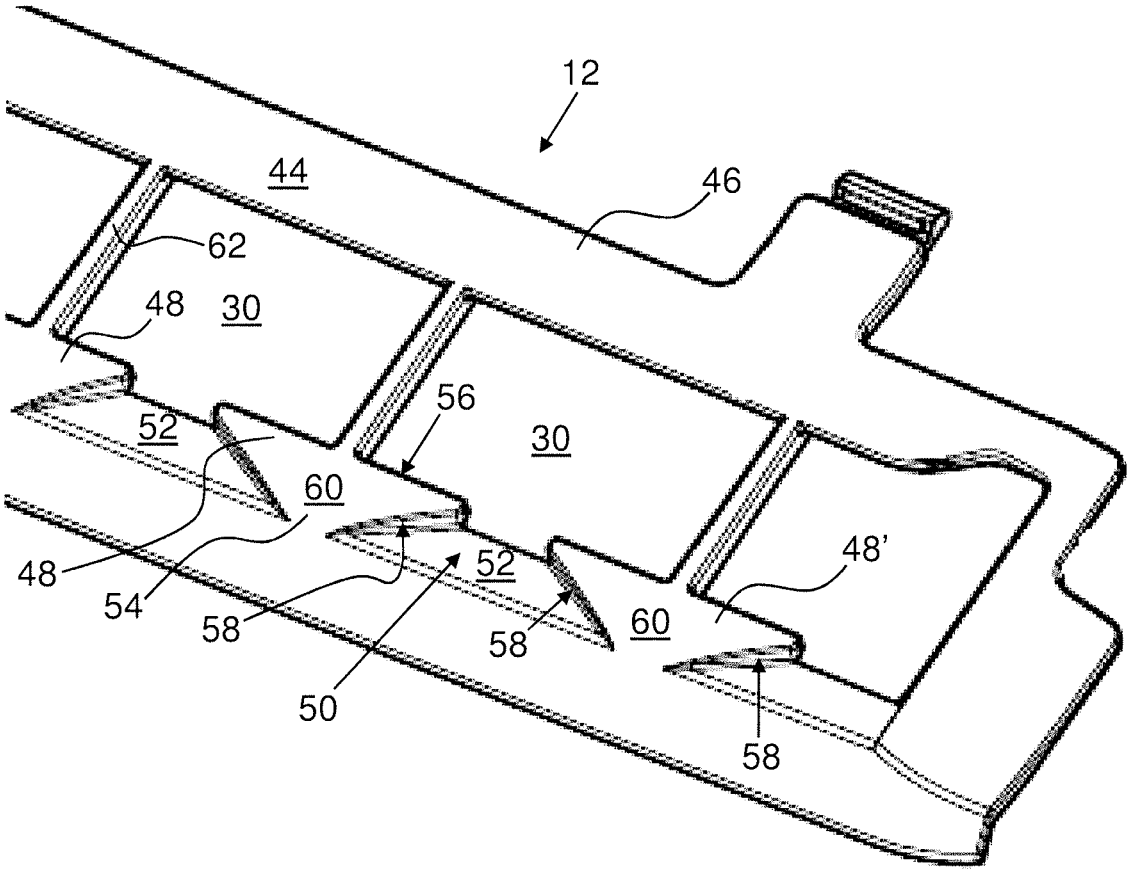
FIG. 4 illustrates a partial enlargement of the nozzle inlet shown in FIG. 3.

FIG. 4 illustrates a partial enlargement of the nozzle inlet 12 shown in FIG. 3. The channel 50 has a delimiting surface 52 extending at a second level substantially in parallel with the first level. In use of the robotic vacuum cleaner the first level is arranged closer to the surface to be cleaned than the second level. Each distance member 48 has a substantially triangular cross section extending substantially in parallel with the first plane. Each distance member 48 extends between the first level and the second level with a top 54 of the substantially triangular cross section facing outwardly from the opening 30 and a base 56 of the substantially triangular cross section extending in parallel with the opening 30. Side surfaces 58 of the distance members 48 extend substantially from the top 54 to the base 56 of the substantially triangular cross section. At least a portion of the side surfaces 58 extend substantially perpendicularly to the base portion 46 and to the delimiting surface 52 of the channel 50.

The trailing edge portion 44 forms part of the base portion 46 and part of the side portion 36 of the nozzle inlet 12. In these embodiments the side portion 36 extends at the second level. Accordingly, at the base portion 46 the trailing edge portion 44 extends at the first level and at the side portion 36 the trailing edge portion 44 extends at the second level. In alternative embodiments the entire trailing edge portion 44 may extend at the first level.

It is clearly visible in FIGS. 3 and 4 that the delimiting surface 52 extends at a different level than the base portion 46, i.e. at the second level. Also at a lateral end 47 of the nozzle inlet 12 and at the trailing edge portion 44 of the side portion 36, the side portion 36 may extend at the second level. Alternatively, the lateral end 47 and the trailing edge portion 44 of the side portion 36 may extend at the first level. As also clearly visible in FIGS. 3 and 4, the leading edge portion 42 comprises a number of portions extending at the second level, namely delimiting surfaces 52 of channels formed between the distance members 48 as well at end portions of the opening 30 next to the outer distance members 48'.

The nozzle inlet 12 comprises at least one cross brace 62 extending from at least one of the distance members 48 to the trailing edge 44. The at least one cross brace 62 forms part of the base portion 46 and extends at the first level.

The substantially triangular cross section of two adjacent distance members 48 reduce the cross section of the channel 50 formed there between towards the opening 30. Thus, one of the side surfaces 58 of a first of the at least two distance members 48 and one thereto opposing side surface 58 of a second of the at least two distance members 48 forms a funnel towards the opening 30.

A bottom surface 60 of each of the distance members 48 forms a smooth transition between the second level and the first level.

Figure 5:
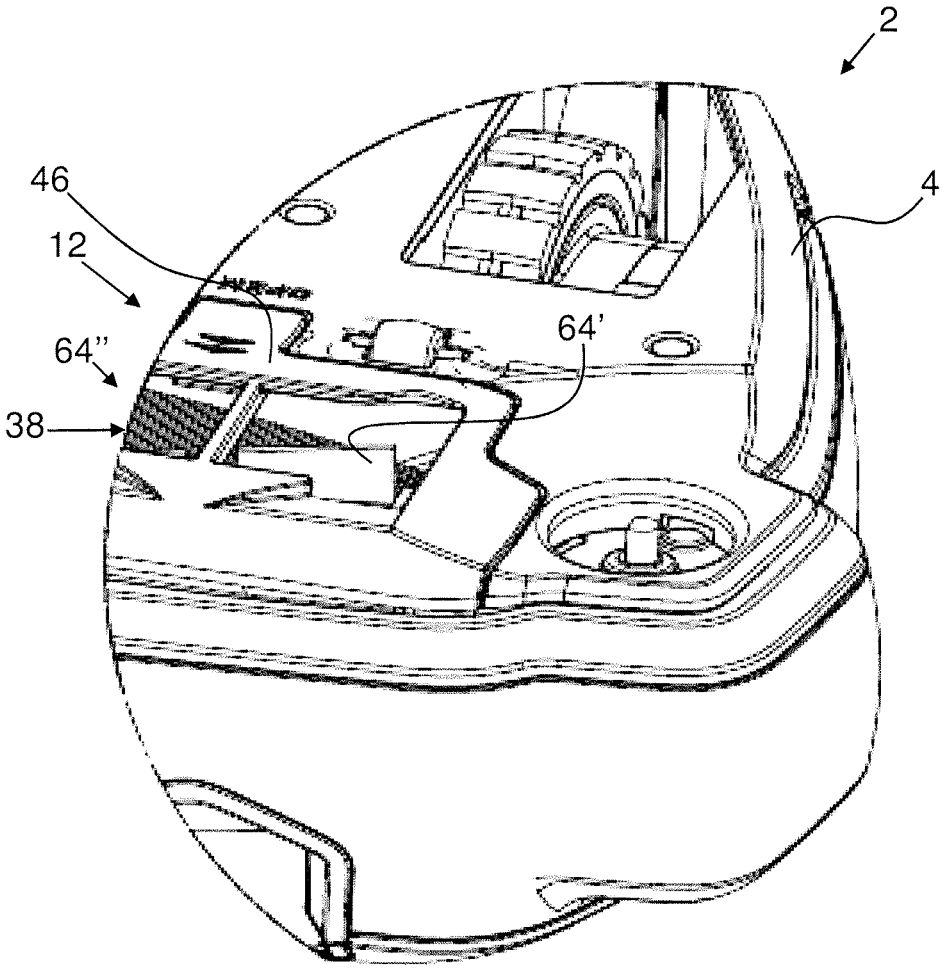
FIG. 5 illustrates a partial enlargement of an area of FIG. 2.

FIG. 5 illustrates an enlargement of the encircled area V of FIG. 2 with the rotatable side brush removed for the sake of clarity. As discussed in connection with FIG. 2, the robotic vacuum cleaner 2 comprises a rotatable elongated brush roll 38 arranged inside the housing 4 and extending along the nozzle inlet 12. The rotatable elongated brush roll 38 comprises radially extending members 64', 64" extending from inside the housing 40 at least to the first level. In these embodiments, a first radially extending member 64' of the radially extending members comprises a resilient lip and a second radially extending member 64" of the radially extending members comprises bristles. Alternatively, all radially extending members 64', 64" may comprise resilient lips or bristles.

In use of the robotic vacuum cleaner 2, the base member 46 at the first level may extend at a distance of less than 2 mm from the surface to be cleaned. In use of the robotic vacuum cleaner 2, the base portion 46 may be that part of the nozzle inlet 12 which extends closest to the surface to be cleaned. In use of robotic vacuum cleaner 2, the nozzle inlet 12 may form part of the housing 4 or alternatively, may be attached to the housing 4, and wherein the base portion 46 may extend closest to the surface to be cleaned of the nozzle inlet 12 and the housing 4.

This invention should not be construed as limited to the embodiments set forth herein. A person skilled in the art will realize that different features of the embodiments disclosed herein may be combined to create embodiments other than those described herein, without departing from the scope of the present invention, as defined by the appended claims. Although the invention has been described with reference to example embodiments, many different alterations, modifications and the like will become apparent for those skilled in the art. Therefore, it is to be understood that the foregoing is illustrative of various example embodiments and that the invention is defined only by the appended claims.

As used herein, the term "comprising" or "comprises" is open-ended, and includes one or more stated features, elements, steps, components or functions but does not preclude the presence or addition of one or more other features, elements, steps, components, functions or groups thereof.

The invention claimed is:

1. A robotic vacuum cleaner comprising:

a housing;

a drive arrangement being configured to drive the vacuum cleaner along a surface to be cleaned;

a vacuum producing unit;

a debris receptacle; and a nozzle inlet arranged in a portion of the housing facing the surface to be cleaned, the nozzle inlet comprising a frame structure having:

an opening in fluid communication with the debris receptacle and the vacuum producing unit;

a leading edge portion bordering on a first side of the opening;

a trailing edge portion bordering on a second side of the opening, the second side being opposite the first side;

a base portion extending substantially in parallel with the surface to be cleaned, the base portion extending at a first level;

at least two distance members located on the leading edge portion and forming there between a channel to the opening, the channel having a delimiting surface extending at a second level substantially in parallel with the first level, the first level being arranged closer to the surface to be cleaned than the second level; and at least two cross braces each extending straight along the first level from a first end to a second end, wherein each distance member has a substantially triangular cross section extending substantially in parallel with the first level, the distance member extending between the first level and the second level with a top of the substantially triangular cross section facing outwardly from the opening and a base of the substantially triangular cross section extending in parallel with the opening, wherein the first end of each the at least two cross braces connects to the base of the substantially triangular cross section of a respective one of the at least two distance members, and the second end of each the at least two cross braces connects to the trailing edge portion of the frame structure, wherein side surfaces of the distance member extend substantially from the top to the base of the substantially triangular cross section, at least a portion of the side surfaces extending substantially perpendicularly to the base portion, wherein the channel is formed between and outside of the substantially triangular cross sections of the at least two distance members, and wherein one of the side surfaces of a first of the at least two distance members and one thereto opposing side surface of a second of the at least two distance members form a funnel to direct debris through the channel towards the opening.

2. The robotic vacuum cleaner according to claim 1, wherein the first level extends at distance less than 2 mm from the surface to be cleaned.

3. The robotic vacuum cleaner according to claim 1, wherein the base portion is that part of the nozzle inlet which extends closest to the surface to be cleaned.

4. The robotic vacuum cleaner according to claim 3, wherein the nozzle inlet forms part of the housing or is attached to the housing, and wherein the base portion extends closest to the surface to be cleaned of the nozzle inlet and the housing.

5. The robotic vacuum cleaner according to claim 1, wherein a bottom surface of each of the distance members forms a smooth transition between the second level and the first level.

6. The robotic vacuum cleaner according to claim 1, wherein the nozzle inlet comprises at least one cross brace extending from at least one of the distance members to the trailing edge portion.

7. The robotic vacuum cleaner according to claim 6, wherein the at least one cross brace forms part of the base portion and extends at the first level.

8. The robotic vacuum cleaner according to claim 1, further comprising a rotatable elongated brush roll arranged inside the housing and extending along the nozzle inlet, the rotatable elongated brush roll comprising radially extending members extending from inside the housing at least to the first level.

9. The robotic vacuum cleaner according to claim 8, wherein a first radially extending member of the radially extending members comprises a resilient lip and a second radially extending member of the radially extending members comprises bristles.

* * * * *